US006302510B1

(12) United States Patent
Yoshida

(10) Patent No.: US 6,302,510 B1
(45) Date of Patent: Oct. 16, 2001

(54) METHOD AND APPARATUS FOR DETECTING PRINTING STATUS OF PRINT HEAD

(75) Inventor: Kiyoshi Yoshida, Tokoname (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/122,623

(22) Filed: Jul. 27, 1998

(30) Foreign Application Priority Data

Jul. 26, 1997 (JP) ..... 9-215922

(51) Int. Cl.[7] ..... B41J 29/393
(52) U.S. Cl. ..... 347/19
(58) Field of Search ..... 347/19, 16, 104, 347/105, 106, 40, 23, 14; 400/708

(56) References Cited

U.S. PATENT DOCUMENTS 5,521,674 * 5/1996 Guillory et al. ..... 347/16
5,539,434 * 7/1996 Fuse ..... 347/19
5,650,804 * 7/1997 Kawamura et al. ..... 347/19
5,798,773 * 8/1998 Hiramatsu et al. ..... 347/19

* cited by examiner

*Primary Examiner*—Huan Tran
*Assistant Examiner*—Charles W. Stewart
(74) *Attorney, Agent, or Firm*—Oliff & Berridge, PLC

(57) ABSTRACT

A mark selection sheet is prepared. The mark selection sheet is preprinted with a plurality of setting marks. The setting marks are printed at various positions and with various sizes. Intensity of light reflected from each setting mark is detected by a reflection type sensor. Based on the detected results, an optimum position, an optimum height, and an optimum width of a quality-check mark is selected, and then stored in an EEPROM.

32 Claims, 17 Drawing Sheets

METHOD AND APPARATUS FOR DETECTING PRINTING STATUS OF PRINT HEAD

BACKGROUND OF THE INVENTION

1. Field of the Invention

The present invention relates to a method and device for judging printing status of a printing device provided in a printer, a facsimile machine, and the like.

2. Description of Related Art

There has been known a printing apparatus, such as a printer, a facsimile machine, and the like, provided with a printing device such as an ink jet print head formed with a plurality of nozzles. Ink is supplied to the print head from an ink tank provided within an ink cartridge. The print head will perform defective printing when ink runs out of the cartridge. The printing apparatus therefore detects whether or not the ink tank has run out of ink. For example, the printing apparatus may calculate the number of times printing has been performed by the print head. Or, the printing apparatus may directly detect the amount of ink remaining in the ink tank. When determining that the ink tank has almost run out of ink, then the apparatus displays a message for urging a user to replace the ink cartridge with a new one. This replacing operation can prevent the print head from performing defective printing.

SUMMARY OF THE INVENTION

However, the print head may perform defective printing even when sufficient ink remains in the ink tank. That is, nozzles of the print head can sometimes become clogged so that quality of printing becomes poor. The above-described method for detecting whether ink has run out or not is incapable of detecting degradation of print quality caused by clogged nozzles. Therefore, printing will continue even if print quality becomes poor because the nozzles are clogged.

This is particularly a problem in facsimile machines that print images based on data transmitted from an external device, and then erase the data from the memory after printing the corresponding images. In this case, even if the user later notices that the images were not properly printed because of clogged head nozzles, he or she can do nothing to reprint them, because the corresponding data no longer exists.

It is conceivable to provide an improved printing apparatus which can automatically check reduction in quality of printed images, regardless of whether the reduction in quality is caused by clogged nozzles or by ink running out. In this conceivable printing apparatus, the print head is controlled to print a quality-check mark on a margin portion of a print sheet. The print head is controlled to print the quality-check mark at a predetermined position in the margin portion and to have a predetermined size. The conceivable printing apparatus is provided with a reflection type sensor for irradiating the quality-check mark with light and then for receiving light that reflects off the quality-check mark. The reflection type sensor is designed to output a detection signal whose value corresponds to the amount of the received light. The detection value is then compared with a threshold value. When the detection value is smaller than the threshold value and is near to a predetermined white level, then it is determined that printing is defective.

Individual printing apparatuses are commonly stored with fixed data indicative of the predetermined position and size, at which the quality-checking mark should be printed.

Accordingly, in all the printing devices, the print head prints the quality-check mark on the print sheet at the same position and by the same size. Individual printing apparatuses are, however, slightly different from one another at the position where the reflection type sensor is attached. Individual printing devices are also slightly different from one another at the position of the path, along which the print sheets are transported, relative to the print head. These hardware variations will discourage some printing apparatuses to attempt to accurately detect the quality-check mark. That is, the reflection type sensors in some printing apparatuses become unable to accurately detect the density of the quality-check mark. For example, even when printing is being properly performed, the reflection type sensor may possibly fail to accurately detect the quality-check mark and therefore may determine that the printing situation is degraded.

In order to solve this problem, it is conceivable to increase the size of the quality-check mark to insure that it is detected by the reflection type sensor. However, in this case, the large quality-check mark would be noticeable to users so such a solution is not desirable.

It is an objective of the present invention to overcome the above-described problems and to provide an improved method and apparatus which is capable of printing a quality-check mark in a size and at a position within the sheet appropriate for detection by the reflection type sensor, and therefore which can accurately detect a printing status of a printing device such as a print head.

In order to attain the above and other objects, the present invention provides a method for detecting a printing state of a printing device, the method comprising the steps of: setting a printing condition for printing a quality-check mark on a printing sheet with using a detection sensor; controlling a printing device to print a quality-check mark at the set printing condition on a printing sheet; controlling the detection sensor to detect the quality-check mark; and determining a printing state of the printing device based on the detected result.

According to another aspect, the present invention provides a printing apparatus for printing a desired image on a printing sheet with a printing device while detecting a printing state of the printing device, the apparatus comprising: a printing device capable of printing a desired image onto a printing sheet; a detection sensor capable of detecting a state of a mark printed on a sheet; mark printing condition setting means for setting a printing condition for printing a quality-check mark on a printing sheet with using the detection sensor; print control means for controlling the printing device to print a desired image on the printing sheet and to print a quality-check mark at the set printing condition on the printing sheet; detection control means for controlling the detection sensor to detect the quality-check mark; and determination means for determining a printing state of the printing device based on the detected result.

According to still another aspect, the present invention provides a method for determining a printing status of a printing device, the method comprising the steps of: transporting a mark selection sheet, the mark selection sheet being printed with a plurality of position setting marks and a plurality of size setting marks at positions separated from one another in a sheet transport direction of the mark selection sheet, the plurality of position setting marks being printed in the same size and at different print positions from one edge of the sheet, the plurality of size setting marks being printed in different sizes and at the same print position from the edge of the sheet, the mark selection sheet being transported so that the position setting marks and the size setting marks serially reach a predetermined reflection type sensor positioned at a predetermined detection position; controlling the reflection type sensor to serially detect the position setting marks and the size setting marks, the reflection type sensor irradiating light onto each position setting mark and each size setting mark and receiving light reflected therefrom, thereby outputting a detection signal; setting, in a rewritable non-volatile memory, a print position of one of the plurality of position setting marks that allows the reflection type sensor to output a detection signal nearest to a predetermined black level; determining at least one of the plurality of size setting marks that allows the reflection type sensor to output a detection signal capable of being regarded as the predetermined black level, selecting one of the determined at least one size setting mark that has the smallest size among the at least one size setting mark, and setting the print size of the selected one size setting mark in the rewritable non-volatile memory; controlling a printing device to print, on a printing sheet, a quality-check mark in the print size stored in the non-volatile memory and at the print position stored in the non-volatile memory; controlling the reflection type sensor to irradiate light onto the quality-check mark, to detect light reflected from the quality-check mark, and to output a detection signal; comparing the detection signal with a threshold value; and determining that the printing device performs defective printing when the detection signal is nearer to a predetermined white level than the threshold value.

According to another aspect, the present invention provides a printing device, comprising: a sheet transport means capable of transporting a sheet along a predetermined sheet transport path in a direction toward a predetermined sheet discharge port; an ink jet print head provided in a predetermined printing position over the predetermined sheet transport path, the ink jet print head including a plurality of nozzles; a reflection type sensor located at a detection position between the printing position and the sheet discharge port, the reflection type sensor including a light emitting element for emitting light toward the detection position on the sheet transport path and a light receiving element for receiving light reflected therefrom to output a detection signal indicative of intensity of the reflected light; a rewritable non-volatile memory means capable of being stored with data of a printing position and a printing size of a quality-check mark; position setting mark information memory means for storing data of a plurality of position setting marks printed on a mark selection sheet as separated from one another in the sheet transport direction, the plurality of position setting marks being printed at the same size, at the corresponding different positions defined along the sheet transport direction, and at different print positions from one edge of the mark selection sheet, the data including the size, the positions along the sheet transport direction, and the positions from the edge of the mark selection sheet; size setting mark information memory means for storing data of a plurality of size setting marks printed on the mark selection sheet as separated from one another in the sheet transport direction, the plurality of size setting marks being printed at different sizes, at the corresponding different positions defined along the sheet transport direction, and at the same print position from the edge of the mark selection sheet, the data including the sizes, the positions along the sheet transport direction, and the position from the edge of the mark selection sheet; print position setting means for controlling the sheet transport means to transport the mark selection sheet, while referring to the data stored in the position setting mark information memory means, so that the plurality of position setting marks will serially reach the detection position, thereby allowing the reflection type sensor to output detection signals indicative of intensity of light reflected from all the position setting marks, the print position setting means selecting one of the position setting marks that causes the reflection type sensor to output a detection signal nearest to a predetermined black level and setting, in the rewritable non-volatile memory means, data of the print position of the selected position setting mark from the edge of the mark selection sheet; print size setting means for controlling the sheet transport means to transport the mark selection sheet, while referring to the data stored in the size setting mark information memory means, so that the plurality of size setting marks will serially reach the detection position, thereby allowing the reflection type sensor to output detection signals indicative of intensity of light reflected from all the size setting marks, the print size setting means determining at least one of the size setting marks that causes the reflection type sensor to output a detection signal capable of being substantially near to the predetermined black level, selecting one of the determined at least one size setting mark that has the smallest size among the at least one size setting mark, and setting, in the rewritable non-volatile memory means, data of the print size of the selected size setting mark; printing execution means for controlling, based on inputted print data, the ink jet print head and the sheet transport means to perform desired printing on a printing sheet; quality-check mark printing means for further controlling the sheet transport means to transport the printing sheet after the printing operation so as to bring a predetermined background portion of the printing sheet into the printing position, and for controlling the ink jet print head to print a quality-check mark at the print size and at the print position from the edge of the printing sheet, data of which is stored in the rewritable non-volatile memory; and printing status judging means for controlling the sheet transport means to transport the printing sheet so that the quality-check mark reaches the detection position, for controlling the light emitting element of the reflection type sensor to emit light onto the quality-check mark, thereby causing the light receiving element to receive light reflected from the quality-check mark and to output a detection signal, for comparing the detection signal with a threshold value, and for judging that the ink jet print head performs defective printing when the detection signal is nearer to a predetermined white level than the threshold value.

The printing device may further comprise mark selection sheet production means for producing the mark selection sheet through controlling, based on the data stored in the position setting mark information memory means and the size setting mark information memory means, the ink jet print head and the sheet transport means to print the plurality of position setting marks and the plurality of size setting marks onto the mark selection sheet.

The mark selection sheet production means may include: position setting mark printing means for controlling, based on the data stored in the position setting mark information memory means, the ink Jet print head and the sheet transport means to print the plurality of position setting marks onto the mark selection sheet; position setting control means for controlling the print position setting means to select one position setting mark and to set, in the rewritable non-volatile memory means, data of the print position of the selected position setting mark from the edge of the mark selection sheet; size setting information control means for controlling the size setting mark information memory means to store data of the print position of the plurality of size setting marks from the edge of the mark selection sheet so that the plurality of size setting marks are to be printed at the same print position, from the edge of the mark selection sheet, set by the position setting control means; and size setting mark printing means for controlling, based on the data stored in the size setting mark information memory means, the ink Jet print head and the sheet transport means to print the plurality of size setting marks onto the mark selection sheet at the same position from the edge of the sheet set by the position setting control means.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Figure 1:
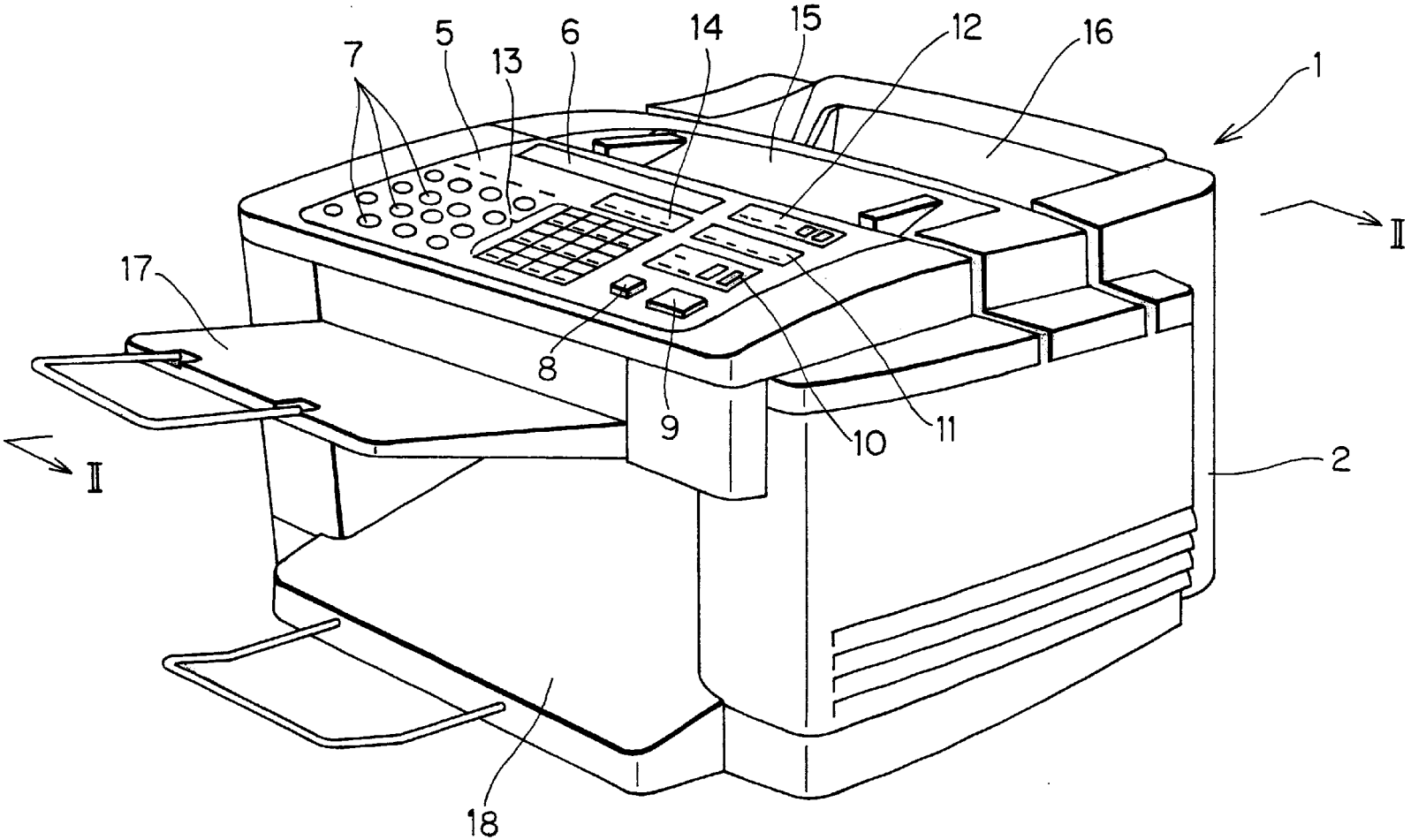
FIG. 1 is an external perspective view showing a multifunction device according to a first embodiment of the present invention.

A multifunction device 1 according to preferred embodiments of the present invention will be described while referring to the accompanying drawings wherein like parts and components are designated by the same reference numerals to avoid duplicating description.

A first preferred embodiment will be described below with reference to FIGS. 1 through 16.

FIG. 1 is an external perspective view showing the multifunction device 1 according to the present embodiment.

Directional terms, such as up, down, right, and left, will be used in the following description with reference to the state of the multifunction device 1 located in an orientation shown in FIG. 1.

The multifunction device 1 is capable of performing a variety of different functions such as a print function, a facsimile transmission/reception function, an image retrieval function, a copy function, a telephone function, and an answering function.

As shown in FIG. 1, the multifunction device 1 includes a case 2. An operation panel unit 5 is disposed on the upper surface of the case 2. A liquid crystal display 6 is disposed to the leftward rear of the operation panel unit 5.

The operation panel unit 5 includes a variety of keys 7 to 14 that a user can use to operate the various functions of the multifunction device 1. Dial buttons 7 are disposed at the left side of the operation panel unit 5. One touch dial keys 13 and a facsimile key 14 are disposed in the center of the operation panel unit 5. The other keys 8 to 12 are disposed at the right side of the operation panel unit 5.

The dial buttons 7 are provided for inputting numbers such as telephone numbers. The dial buttons 7 include numeric buttons one through zero, an asterisk button, and a sharp button. The one touch dial keys 13 are provided for simplifying dialing operations. The facsimile key 14 is used to operate the multifunction device 1 as a facsimile machine.

Of the keys on the right side of the operation panel unit 5, a stop key 8 and a start key 9 are both disposed on the front edge of the operation panel unit 5. The stop key 8 is for stopping operation of the multifunction device 1. The start key 9 is for starting operations of the multifunction device 1. A color copy key 10 is disposed behind the stop key 8 and the start key 9. The color copy key 10 is for operating the multifunction device 1 as a color copier. A color printer key 11 is disposed behind the color copy key 10. The color printer key 11 is for operating the multifunction device 1 as a color printer. An answering machine function key 12 is disposed behind the color printer key 11. The answering machine function key 12 is for operating the multifunction device 1 as an answering machine.

A document stack portion 15 is provided to the rear of the operation panel unit 5. The document stack portion 15 is for stacking thereon original documents desired to be scanned to retrieve data corresponding to images on the original documents. A sheet feed portion 16 is provided to the rear of the document stack portion 15. Printing sheets desired to be printed by the multifunction device 1 are stacked on the sheet feed portion 16.

A document stacker 17 is provided in front of the operation panel unit 5. After having been scanned, the original documents are discharged out of the multifunction device 1 and stacked on the document stacker 17. A recorded sheet stacker 18 is provided below the document stacker 17. After having been printed on, the printing sheets are discharged out of the multifunction device 1 and are stacked on the recorded sheet stacker 18.

Figure 2:
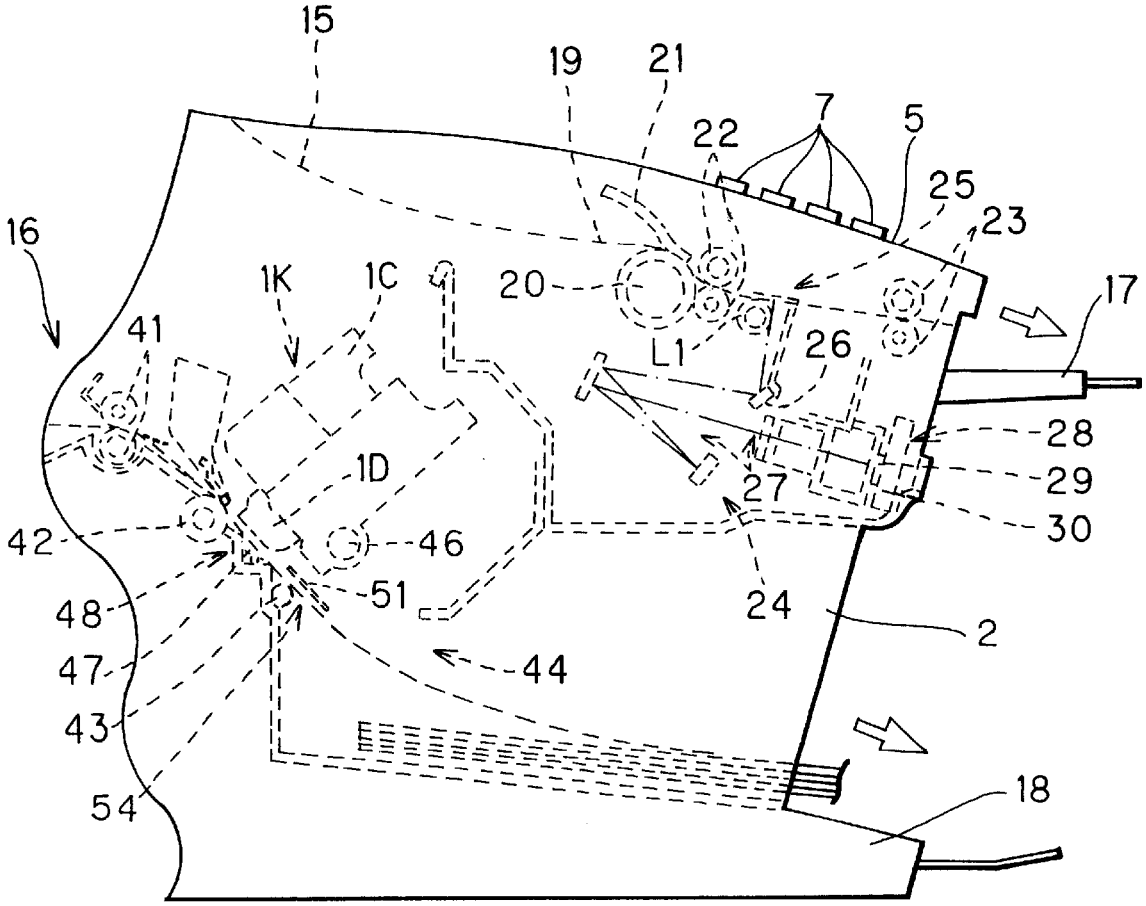
FIG. 2 is a sectional view of an essential part of the multifunction device taken along a line II—II in FIG. 1.

FIG. 2 shows an internal structure of the multifunction device 1. As shown in FIG. 2, a guide pathway 19 is provided for feeding the original documents from the document stack portion 15 toward the document stacker 17. The guide pathway 19 extends within the case 2 and beneath the operation panel unit 5. A document separation roller 20 and a separation rib 21 are disposed along the guide pathway 19 under the operation panel unit 5. The separation rib 21 is in opposition abutment with the document separation roller 20. A pair of upper and lower guide rollers 22 are disposed downstream from the document separation roller 20. Another pair of upper and lower guide rollers 23 are disposed downstream from the pair of guide rollers 22 at a position immediately before the document stacker 17. An image reading device 24 is provided near the front interior portion of the case 2.

With the above-described configuration, original documents stacked on the document stack portion 15 are separated one sheet at a time by the document separation roller 20 and the separation rib 21. Each sheet of original document is then transported downstream while being applied with tension by the guide rollers 22 and 23. Images on each document sheet are retrieved by the image reading device 24 while the document sheet is being transported downstream in this manner.

The image reading device 24 is for retrieving information on the surface of the transported original documents at a predetermined image reading position 25. The image reading position 25 is located between the guide rollers 22 and 23. The image reading device 24 includes: a lamp (light source) L1; a first reflection mirror 26; an optical system 27 including other reflection mirrors; and a charge couple device (CCD) unit 28. The CCD unit 28 is configured from a substrate 30 on which is formed a CCD 29.

The lamp L1 is for irradiating an original document which is being transported following the guide pathway 19 at the image reading position 25. Light reflected from the document surface is reflected by the first reflection mirror 26 and guided by the optical system 27 toward the CCD 29. Thus, the light falls incident on the CCD 29.

The image reading device 24 having the above-described structure is mounted in the case 2 with the substrate 30 being disposed near the upper surface of the case 2. Thus, the CCD 29 mounted on the substrate 30 is located in a relatively upper position in the device 1. The CCD 29 is therefore located near the document pathway 19, which connects the document stack portion 15 and the document stacker 17 which are both located in the upper portion of the device 1. Accordingly, the original document, transported along the pathway 19, can be easily read by the image reading device 24.

A print mechanism IK is disposed behind the image reading device 24 within the case 2. The print mechanism IK includes four ink cartridges IC and an ink Jet head ID connected to the ink cartridges IC. The ink cartridges IC each stores a different colored ink, that is, cyan (C), magenta (M), yellow (Y), and black (K) colored inks. The ink jet head ID is slidably disposed on a carriage bar 46 which extends laterally within the case 2. The ink jet head ID is for recording color images on the surface of printing sheets transported from the sheet supply portion 16. The ink jet head ID is provided with a plurality of cyan ink ejection nozzles, a plurality of magenta ink ejection nozzles, a plurality of yellow ink ejection nozzles, and a plurality of black ink ejection nozzles. The cyan, magenta, yellow, and black ink ejection nozzles are provided in fluid communication with the cyan, magenta, yellow, and black ink cartridges IC, respectively.

The print mechanism IK is of a serial type capable of serially printing color images on the printing sheets. That is, the ink jet head ID is transported laterally within the case 2 along the carriage bar 46 while being activated to record a single line of color image on the sheet surface. When the single line of color image has been recorded, then the sheet is transported a distance equivalent to a single line and the ink jet head ID is activated to print another line of color image.

Figure 3:
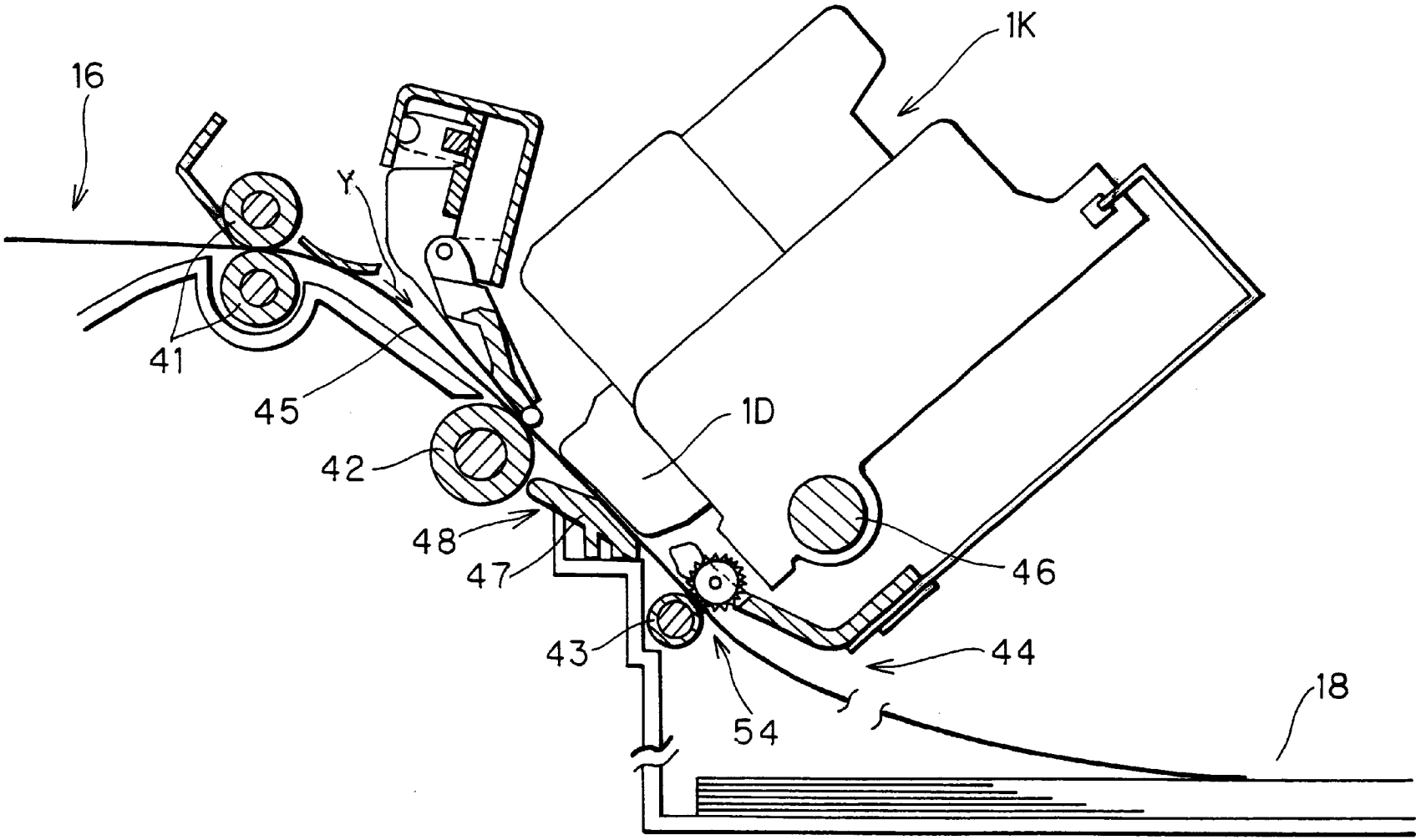
FIG. 3 is a sectional view showing an ink jet print mechanism employed in the multifunction device.

FIG. 3 shows how printing sheets are printed by the print mechanism IK while the printing sheets are transported from the sheet supply portion 16 to the recorded sheet stacker 18. As shown in FIG. 3, a printing sheet pathway 45 extends from the sheet supply portion 16 in a sheet feeding direction (auxiliary scanning direction) Y and reaches the recorded sheet stacker 18 via a sheet discharge port 44. A pair of sheet feed rollers 41 and 41 and another sheet feed roller 42 are disposed along the printing sheet pathway 45 downstream from the sheet supply portion 16 and upstream from the print mechanism IK.

A downstream side sheet feed roller 43 is disposed downstream from the print mechanism IK at a position near to and upstream from the sheet discharge port 44. The sheet feed rollers 41, 42, and 43 are for transporting printing sheets, which are stacked in the sheet supply portion 16, one sheet at a time, in the sheet feeding direction Y passed the print mechanism IK, and then toward the recorded sheet stacker 18. A platen 47 is provided at a position in confrontation with the ink jet head ID of the print mechanism IK. The platen 47 extends in a direction parallel to the carriage bar 46. A printing position 48 is defined above the platen 47. When a not-yet printed sheet reaches the printing position 48, then printing is executed according to the serial print function of the print mechanism IK. More specifically, when the multifunction device 1 operates as a printer or as a copy machine, the print mechanism IK prints images in color. When the multifunction device 1 operates as a facsimile machine, the print mechanism IK prints images in monochrome.

Figure 4:
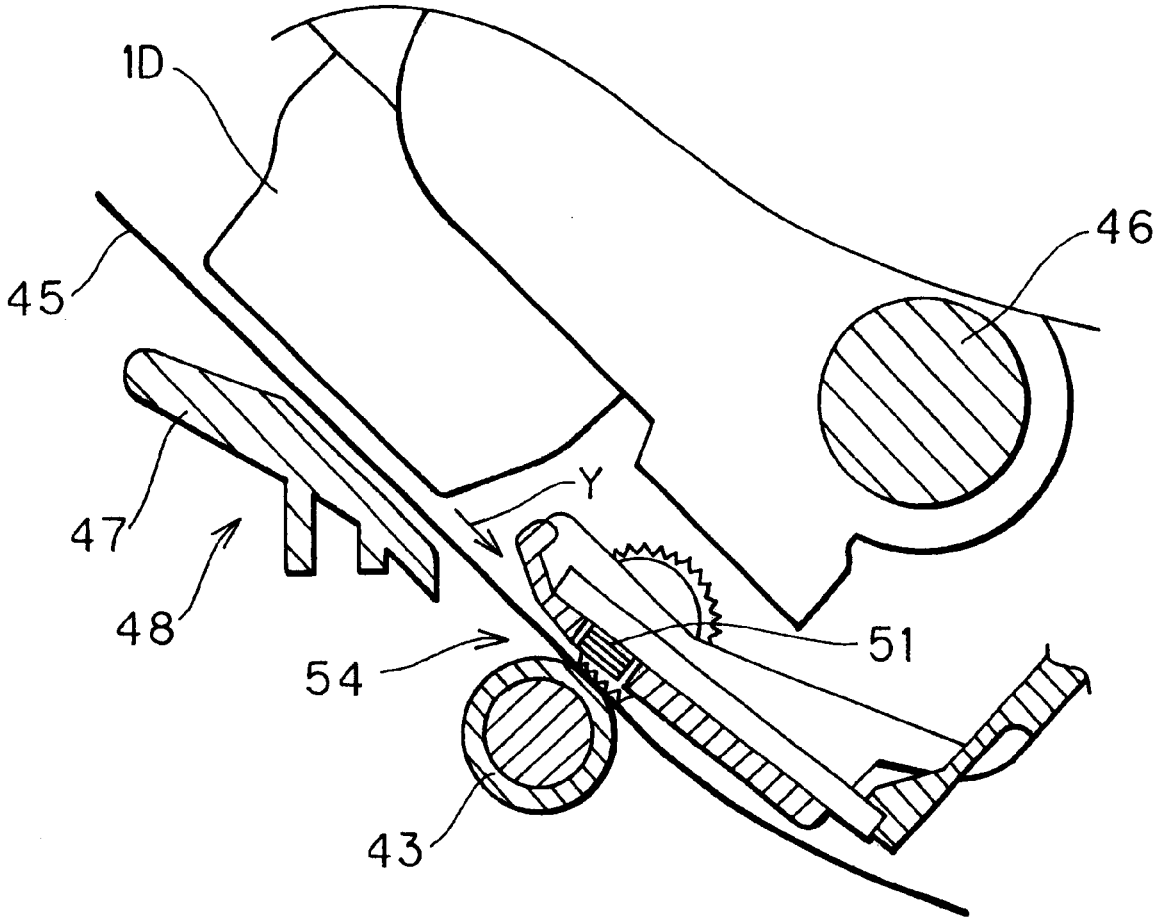
FIG. 4 is a sectional view showing a detection portion in the multifunction device.

As shown in FIG. 4, the downstream side feed roller 43 is located at a detection position 54 which is defined along the printing sheet pathway 45 and downstream from the printing head ID (printing position 48). The roller 43 has a peripheral surface of black color to be used for detecting paper jams in a manner to be described later. A reflection type sensor 51 is attached at the detection position 54 in opposition with the downstream side feed roller 43. The reflection type sensor 51 includes a light emitting diode (LED) 52 and a light reception element 53, shown in FIG. 5, which are located both in the upper side of the sheet pathway 45 in confrontation with the sheet feed roller 43. The LED 52 is for emitting light in a direction toward the peripheral surface of the roller 43. The light reception element 53 is for receiving light falling incident thereon.

The light reception element 53 is constructed from a photosensor. The light reception element 53 is for outputting a detection signal whose voltage corresponds to the intensity of the received light. The voltage of the detection signal increases as the intensity of the received light decreases. The light reception element 53 is originally designed to output a detection voltage Voff of five (5) volts when the LED 52 is turned off and when absolutely no external light intrudes into the case 2. In other words, the reflection type sensor 51 is originally designed to output a black level of five (5) volts. The light reception element 53 is originally designed also to output a detection voltage Von of one (1) volt when the LED 52 is turned on at a maximum duty ratio of 100% and when a white color printing sheet is being transported at the detection portion 54 between the reflection sensor 51 and the roller 43. In other words, the reflection type sensor 51 is originally designed to output a white level of one (1) volt. The reflection type sensor 51 therefore originally has a dynamic range of four (4) volts, assuming no deterioration occurs over time on the reflection type sensor 51.

With the above-described structure, the reflection type sensor 51 serves to obtain, from the detection position 54, information required to judge whether or not paper jams occur on a printing sheet transported along the sheet pathway 45 and information required to judge printing quality attained by the printing mechanism IK.

Figure 11:
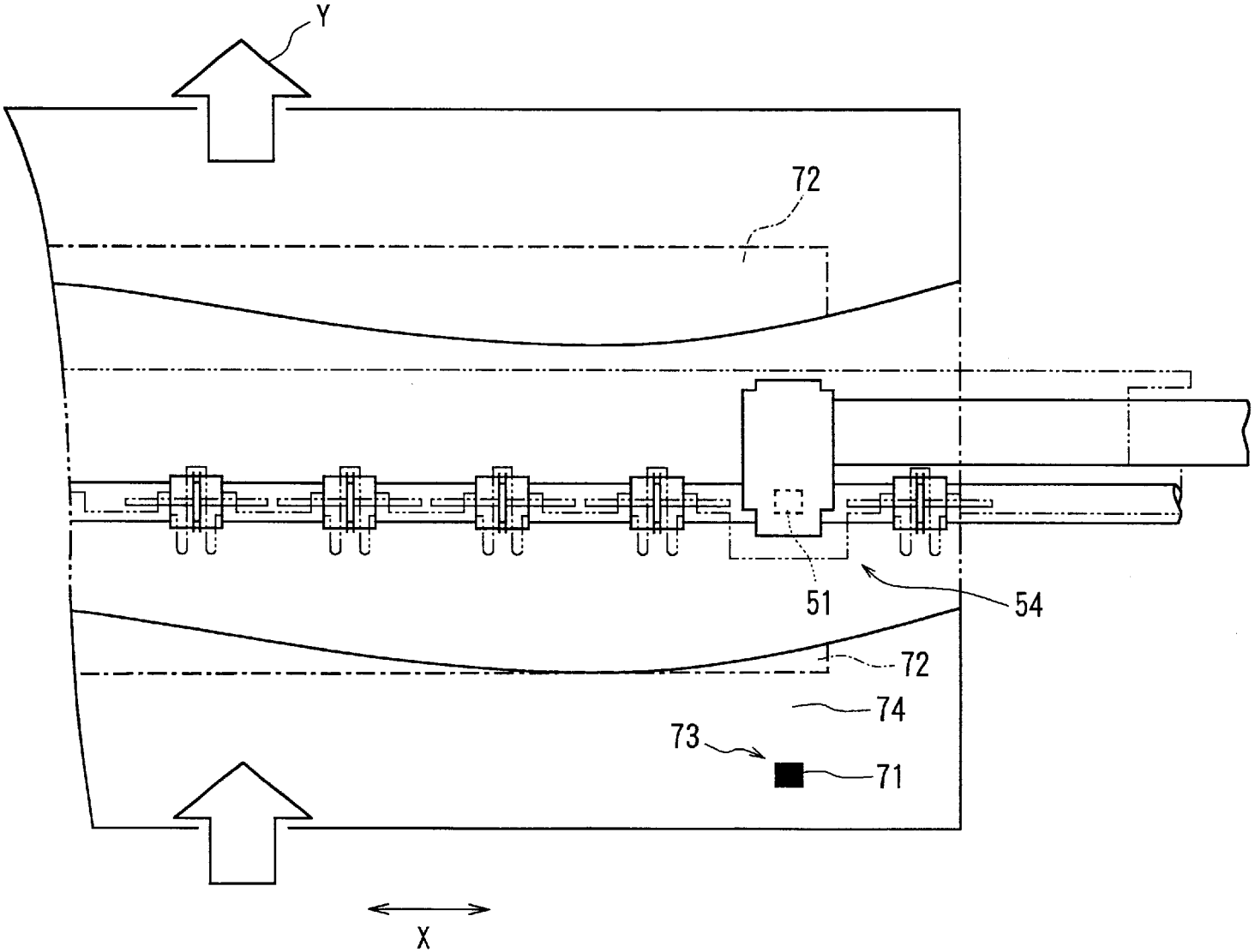
FIG. 11 is a plan view showing how a quality-check mark is printed on a printing sheet on which desired images have been printed.

When each printing sheet starts being transported in the direction Y along the sheet pathway 45, the reflection type sensor 51 is controlled to produce detection signals. The detection signals are used to determine whether or not paper jam occurs at the subject printing sheet. When paper jam does not occur, the printing mechanism ID performs printing operation onto the printing sheet. More specifically, the printing mechanism ID prints images within a print region 72 defined on the sheet surface as shown in FIG. 11. After performing the image printing operation onto the print region 72, the printing mechanism ID further prints a quality-check mark 71 on the sheet surface at a quality-check mark printing position 73. As shown in FIG. 11, the quality-check mark position 73 is located to the rear of the print region 72 and is separated a predetermined distance from the print region 72 along the sheet feeding direction (Y in the figure). When the sheet is further transported along the sheet pathway 45, the quality-check mark position 73 reaches the detection position 54, whereby the quality-check mark 71 is detected by the reflection type sensor 51. Detection signals outputted by the reflection sensor 51 are indicative of quality of printing presently being attained by the print head ID. That is, detection signals outputted by the reflection sensor 51 are used to determine whether or not printing is degraded. The device 1 can determine that the printing is degraded regardless of the reasons whether the print head ID has run out of ink or the nozzles in the print head are clogged with ink.

Figure 5:
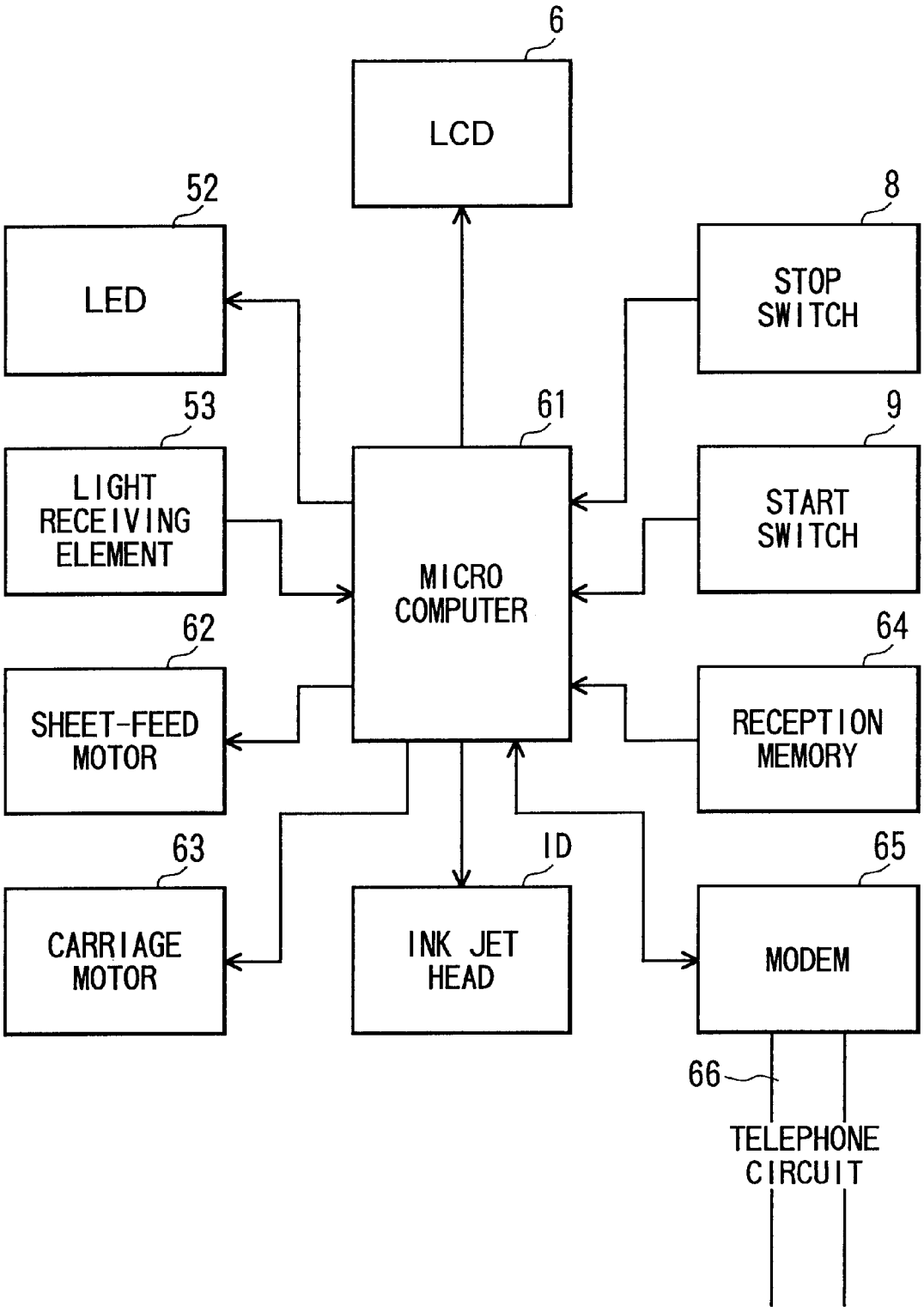
FIG. 5 is a block diagram of a control system employed in the multifunction device to perform a facsimile operation.

The multifunction device 1 has a control system shown in FIG. 5 for performing the facsimile reception function.

As shown in FIG. 5, the control system is centered on a microcomputer 61. The microcomputer 61 is connected to the liquid crystal display 6, the stop key 8, the start key 9, the ink jet head ID, the LED 52, the light reception element 53, a sheet supply motor 62, a carriage motor 63, a reception memory 64, and a modem 65. The modem 65 is connected to a telephone line 66. The modem 65 is for modulating image signals obtained by the CCD 29 to be transmitted to a remote facsimile machine and for demodulating image signals transmitted from a remote facsimile machine. The reception memory 64 is for temporarily storing the demodulated image signals transmitted from the remote facsimile machine. The sheet supply motor 62 is for driving the sheet feed rollers 41, 42, and 43 to feed a printing sheet along the sheet pathway 45 in the auxiliary scanning direction Y shown in FIG. 11. The carriage motor 63 is for reciprocally moving the printing mechanism IK with the print head ID along the carriage bar 46 in a main scanning direction X, which is substantially perpendicular to the auxiliary scanning direction Y.

Figure 6:
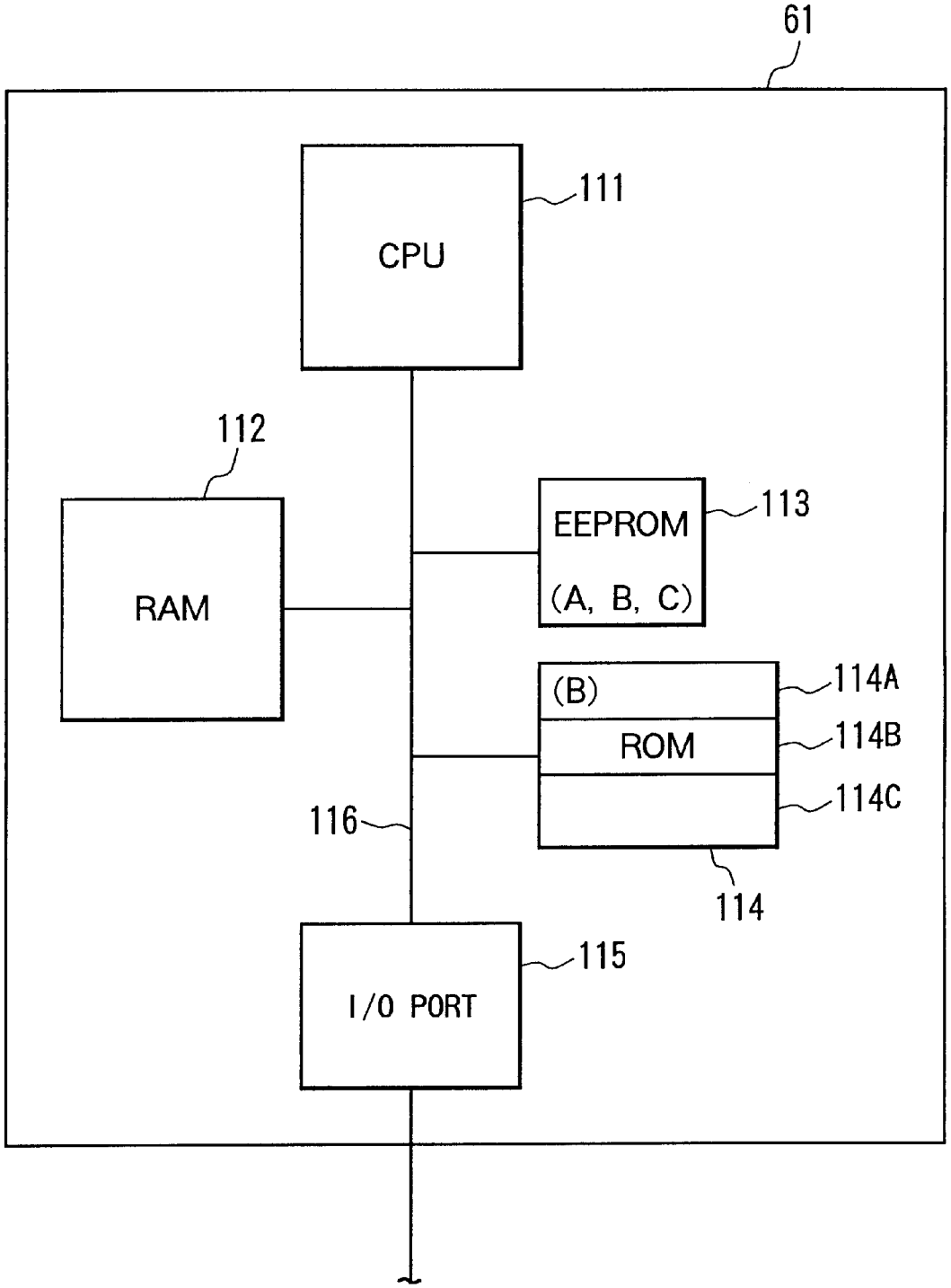
FIG. 6 is a block diagram showing an internal structure of a microcomputer provided in the control system.
Figure 7:
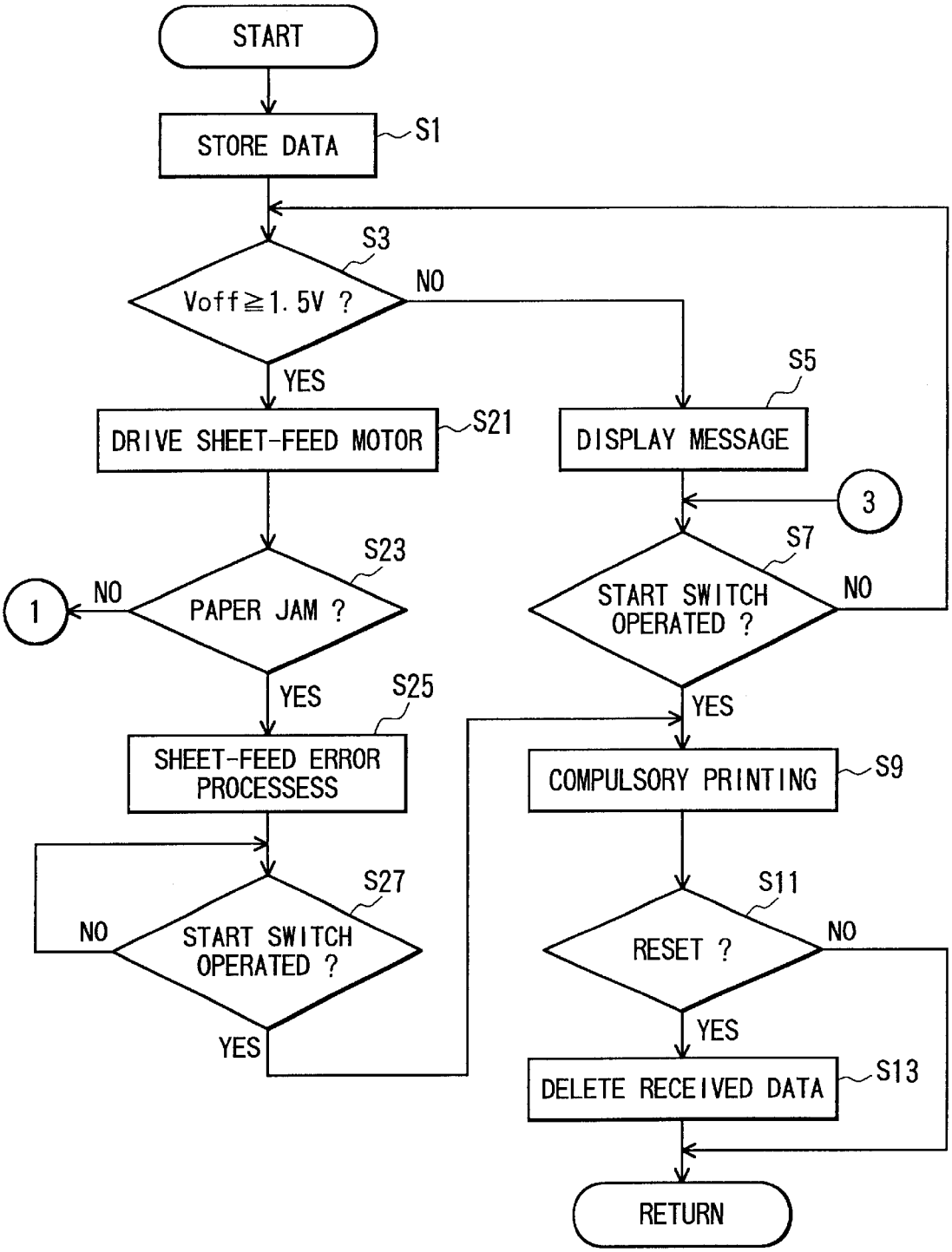
FIG. 7 is a flowchart showing the facsimile reception printing operation executed by the multifunction device.

As shown in FIG. 6, the microcomputer 61 includes a CPU 111, a RAM 112, a rewritable EEPROM (electrically-erasable programmable ROM) 113, a ROM 114, and a variety of input/output ports 115, although only one input/output port is shown in FIG. 6. All these components are interconnected by a bus 116.

Figure 12:
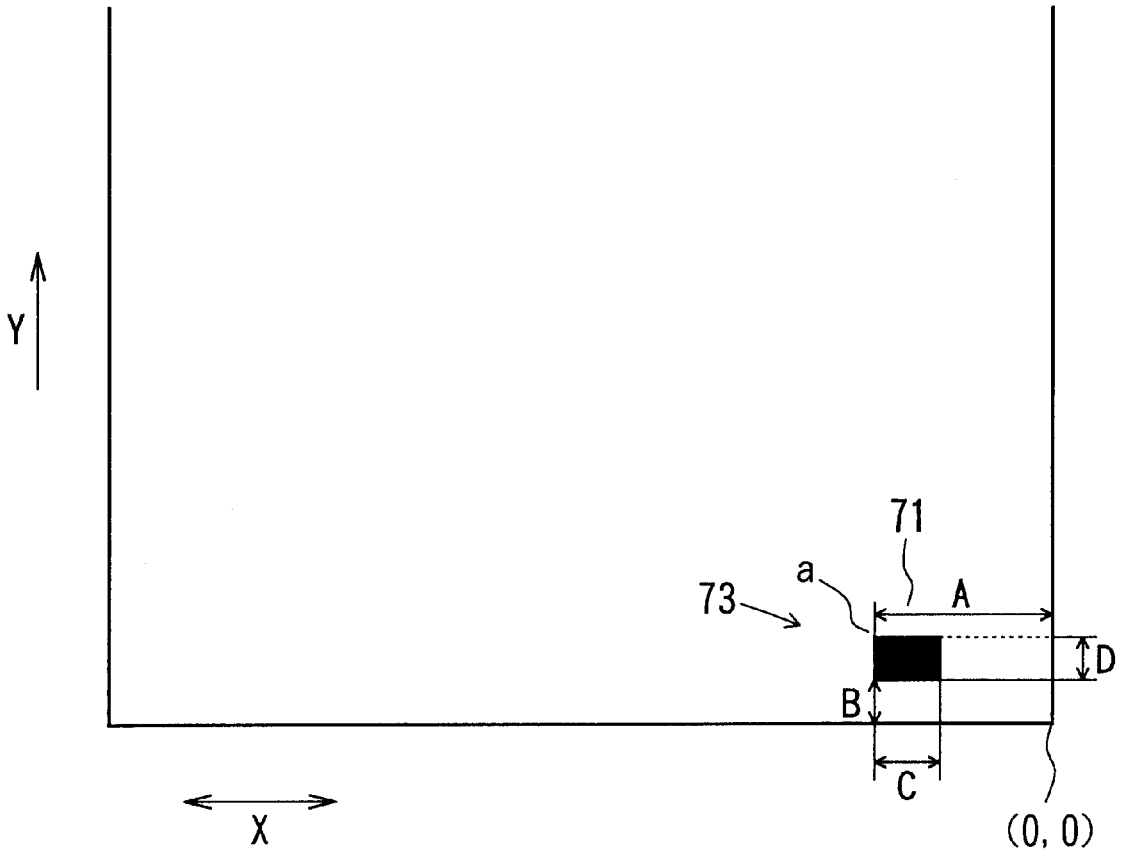
FIG. 12 shows in detail how the quality-check mark is printed on the printing sheet.

The EEPROM 113 is a rewritable non-volatile memory. The EEPROM 113 is for storing data of: a size at which the quality-check mark 71 should be printed; and a position where the quality-check mark 71 should be printed on the printing sheet along the main scanning direction X. The position is defined as a distance "A" from the right side edge of the printing sheet as shown in FIG. 12. Because the printing mechanism IK is controlled to print the quality-check mark 71 in a rectangular shape, the size of the quality-check mark 71 is defined by width "C" and height "D" of the rectangular quality-check mark 71. The size (C and D) of the quality-check mark 71 and the position (A) of the quality-check mark 71 defined along the main scanning direction X are determined according to a mark position/size setting process of FIGS. 14 through 16 as will be described later. Thus, data of the distance A, the width C, and the height D are determined during the mark position/size setting processes of FIGS. 14 through 16, and then are stored in the EEPROM 113. The position of the quality-check mark 71 defined along the auxiliary scanning direction Y is predetermined as fixed. That is, a distance "B" defined between the quality-check mark printing position 73 and the trailing edge of the printing sheet is predetermined as fixed.

The ROM 114 includes regions 114A through 114C. The region 114A stores therein data of a program to be executed by the CPU 111 to perform printing processes of FIGS. 7–10 to be described later. The region 114A also stores therein a variety of data required for executing the printing processes of FIGS. 7–10 except for data C, D, and A relating to the size of the quality-check mark 71 and the position of the quality-check mark 71 along the main scanning direction X. The data A, C, and D is stored in the EEPROM 113 as described above. The region 114A, however, stores therein data B indicative of the position 73 of the quality-check mark 71 along the sheet transport direction (auxiliary scanning direction) Y. The region 114A also stores therein a sensor threshold "A" of a fixed value, which is greater than one (1) volt and which is used for judging whether or not the sensor 51 is in an allowable condition during the processes of FIGS. 7–10.

Figure 14:
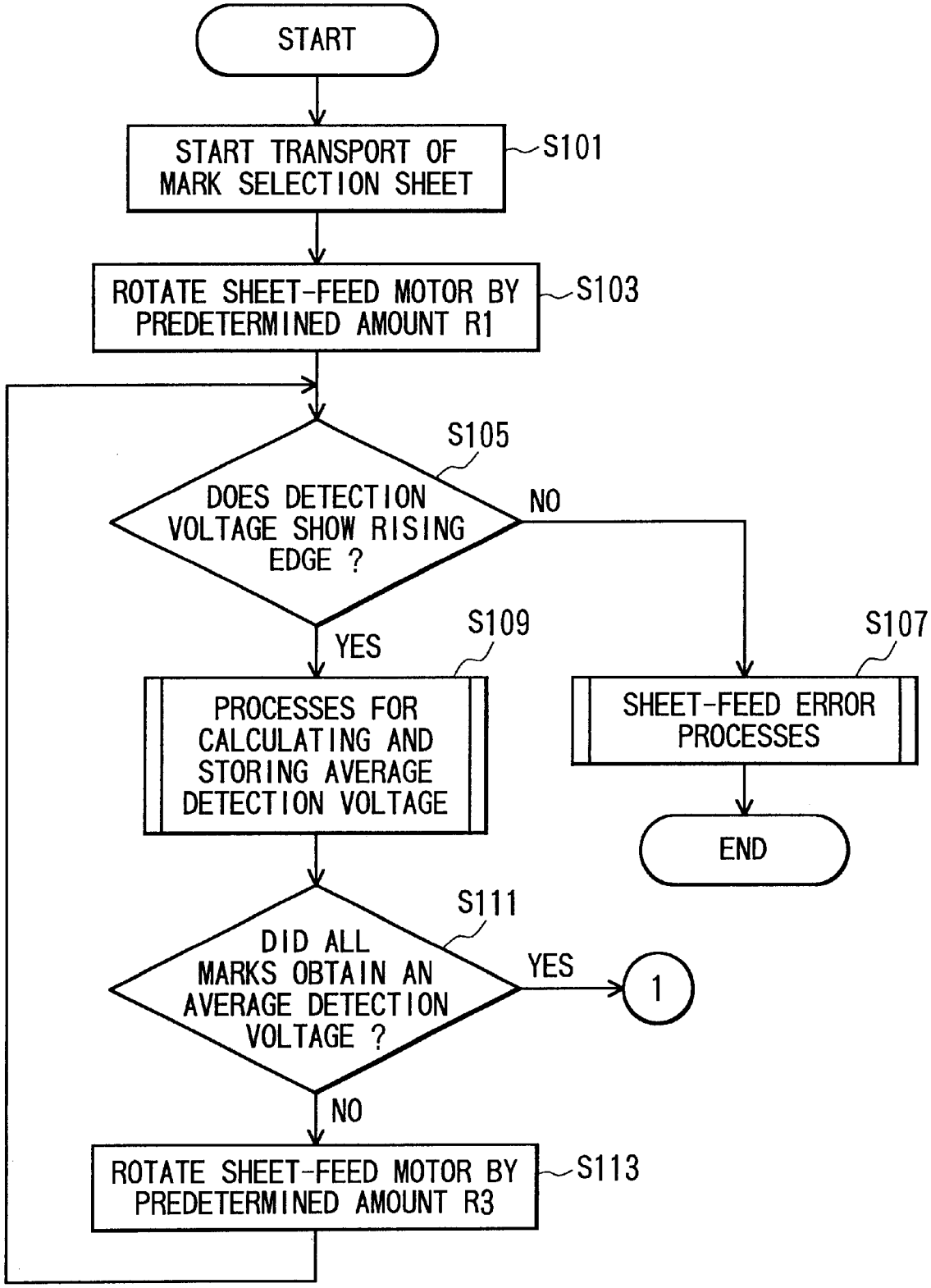
FIG. 14 is a flowchart of a mark size/position setting processes employed by the multifunction device.
Figure 15:
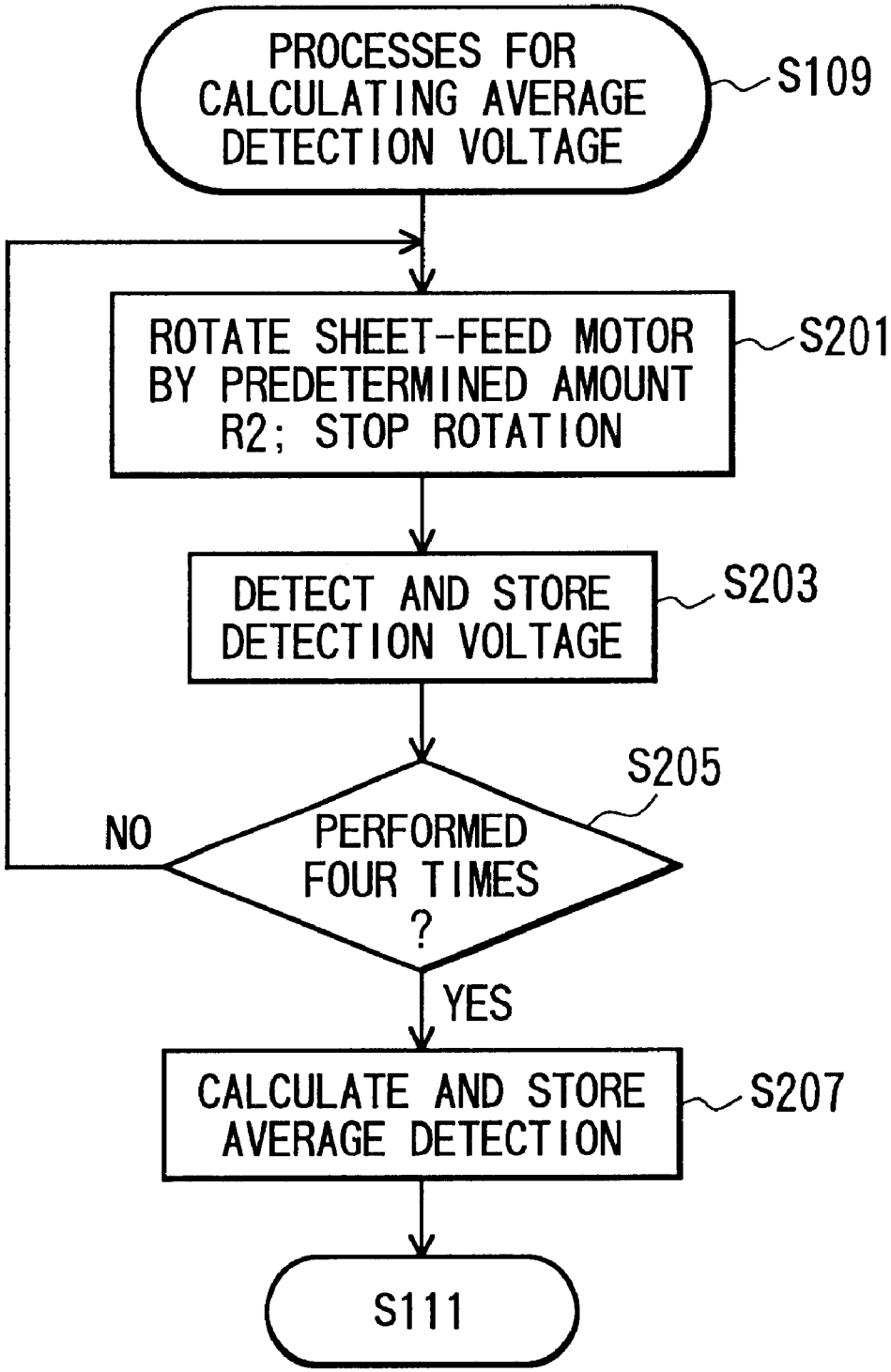
FIG. 15 is a flowchart of a voltage detection and calculation process of S109 in the mark size/position setting processes employed by the multifunction device.
Figure 16:
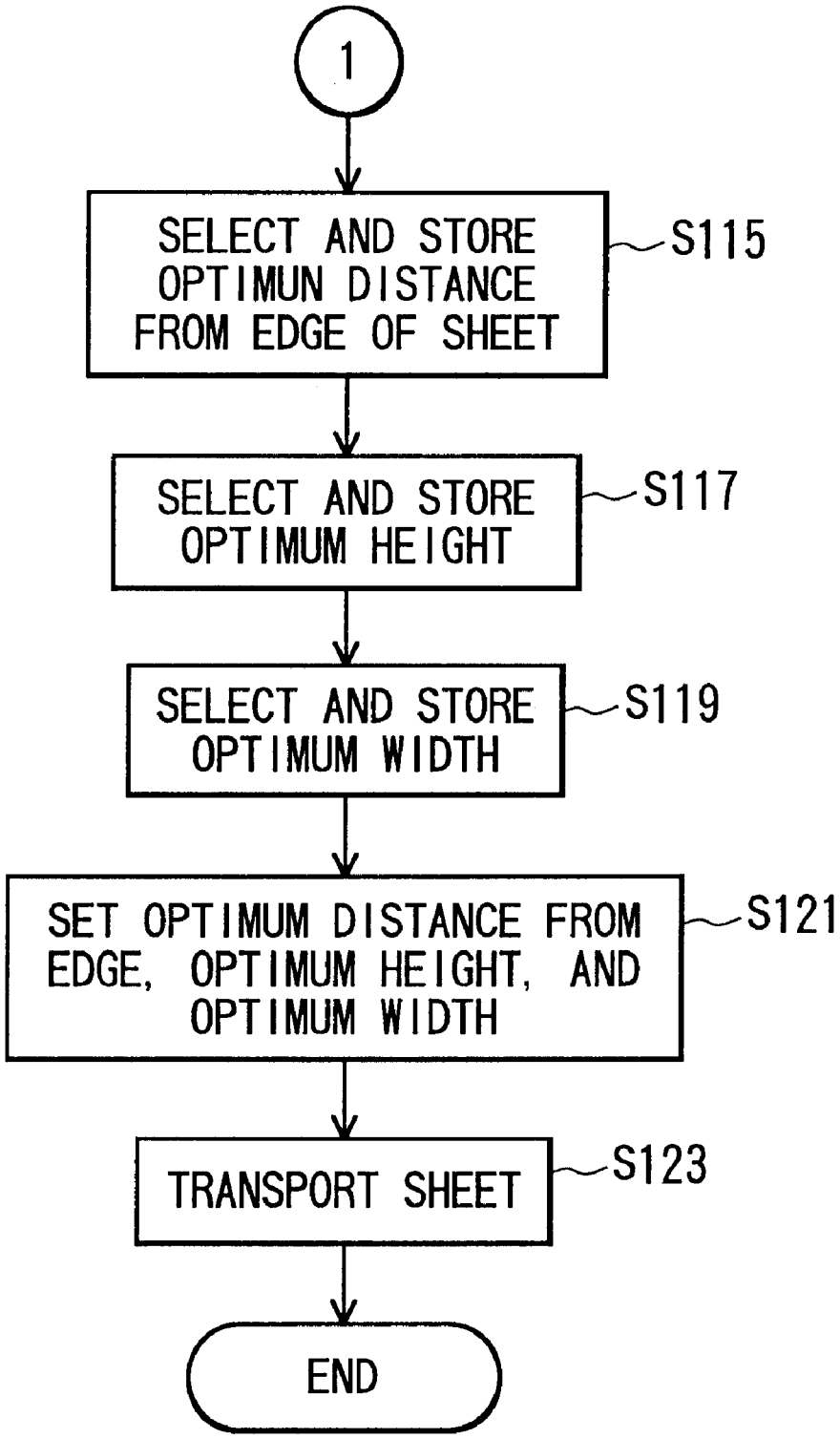
FIG. 16 is a flowchart of a remaining part of the mark size/position setting processes employed by the multifunction device.

The region 114B stores therein data of a program to be executed by the CPU 111 to perform the mark position/size setting processes of FIGS. 14–16 for determining position and size of the quality-check mark 71. The region 114B also stores a variety of data required for executing the mark position/size setting processes of FIGS. 14–16. For example, the region 114B stores therein data of a plurality of different positions and sizes to be selected and set in the EEPROM 113 during the mark position/size setting processes. The region 114C stores a variety of other different data.

With the above-described control system, the multifunction device 1 is capable of performing the mark size/position setting processes of FIGS. 14–16 to set, in the EEPROM 113, size and position where the quality-check mark 71 should be printed. With using data of the thus set size and position, the multifunction device 1 performs its facsimile printing operation as shown in FIGS. 7–10 while judging quality of the printing.

It is noted that the facsimile printing operation is performed in black only through selectively driving the black ink ejection nozzles on the print head ID. Accordingly, during the facsimile printing operation, the quality-check mark 71 is printed also in black only to indicate whether the black ink cartridge IC has run out of ink or whether any of the black ink ejection nozzles are clogged. The mark size/position setting processes of FIGS. 14–16 are therefore designed to determine optimum size and position of the quality-check mark 71 to be printed in black.

The facsimile printing operation will be described below.

When facsimile data is transmitted over the telephone line 66 and received by the modem 65, then, the printing processes of FIGS. 7 to 10 are started. First, in S1, the received data is temporarily stored in the reception memory 64. When the print data has been completely stored in the reception memory 64, then the CPU 111 in the microcomputer 61 receives a detection signal "Qoff" from the light reception element 53 while controlling the LED 52 to maintain its off condition. Then in S3, the CPU 111 judges whether or not the detection voltage Voff of the signal Qoff is equal to or greater than 1.5 volts. In this condition, the reflection type sensor 51 directly confronts the blackened surface of the sheet feed roller 43. Accordingly, the voltage Voff indicates the black level of the reflection sensor 51 in the present circumstances. As described already, the reflection sensor 51 is designed to output the black level voltage Voff of five (5) volts when absolutely no external light intrudes into the case 2 and to output the white level voltage Von of one (1) volt when the LED 52 is turned ON and a white sheet reaches between the reflection sensor 51 and the sheet feed roller 43.

When the black level detection voltage Voff is smaller than 1.5 V (No in S3), the CPU 111 determines that the intensity of external light is too great to properly detect whether a paper jam has occurred or whether defect printing has occurred. Accordingly, the program proceeds to S5, where a message "RECEPTION BEING PERFORMED" is displayed on the liquid crystal display 6 without actually performing print operations. Display of this message will indicate to the user that reception data is present in the memory 64, but is not yet printed out. Next, in S7, the CPU 111 waits the user's operation of the start key 9. When the user presses the start key 9 (Yes in S7) to input his/her desire to print out the received data, then the CPU 111 determines that a command to compel printing operations has been inputted. Therefore, in S9, printing is compulsorily started. Normal facsimile operations are configured to erase reception data once corresponding images have been printed out. However, in the compulsory printing operation of S9 in the present embodiment, print data is retained in the reception memory 64 even after corresponding images have been compulsorily printed out in S9. The print data will be erased from the reception memory 64 in S13 only when a predetermined reset command has been inputted by the user in S11, for example, through simultaneously depressing the start key 9 and the stop key 8. On the other hand, when the operator does not operate the start switch 9 (No in S7), the program returns to S3.

When the black level detection voltage Voff is equal to or greater than 1.5 volts (Yes in S3), the CPU 111 determines that only a sufficiently small amount of external light intrudes into the case 2. Accordingly, the program proceeds to S21, where the sheet supply motor 62 is driven to transport one sheet from the sheet supply portion 16 along the sheet pathway 45 in a direction toward the printing position 48 and toward the detection position 54. Then, in S23, the CPU 111 performs a paper jam detection operation.

During the paper jam detection operation, the CPU 111 turns ON the LED 52 so that the light reception element 53 will output a detection signal Qon. At this time, the light is illuminated on the blackened surface of the roller 43, and reflects off from the blackened surface to reach the light reception element 53. The detection voltage Von of the detection signal Qon therefore initially represents intensity of light reflected from the blackened surface of the roller 43. When the leading edge of the printing sheet properly reaches the detection position 54, light from the LED 52 will reflect off from the surface of the printing sheet before reaching the light reception element 53. Accordingly, the detection voltage Von of the detection signal Qon will change to represent intensity of light reflected from the surface of the printing sheet. The detection voltage Von will therefore drop by a predetermined amount or more in correspondence to a difference between the intensity of light reflected from the blackened surface of the roller 43 and the intensity of light reflected from the printing sheet surface.

The CPU 111 therefore judges in S23 whether or not the detection voltage Von drops by the predetermined amount or more over a predetermined duration of time T0 after the LED 52 is turned ON. The CPU 111 determines that a paper jam occurs when the detection voltage Von does not drop by the predetermined amount or more even after the predetermined duration of time T0 has elapsed after the start of illumination by the LED 52. The predetermined duration of time T0 is a period of time required for the rollers 41 and 42 to transport the printing sheet after the LED illumination starting timing until the leading edge of the printing sheet will reach the detection position 54.

If the CPU 111 determines that a paper jam has occurred (Yes in S23), then the program proceeds to S25, where sheet feed error processes are performed. During the sheet feed error processes of S25, the sheet supply motor 62 is stopped, and a message reading "SHEET FEED ERROR" is displayed on the liquid crystal display 6. Afterward, in S27, the routine waits for the user to clear up the paper jam and then pressing the start key 9. When the user completely clears up the paper jam, and presses the start key 9 (Yes in S27), the reception data is compulsorily printed in S9 in the same manner as described already.

Figure 8:
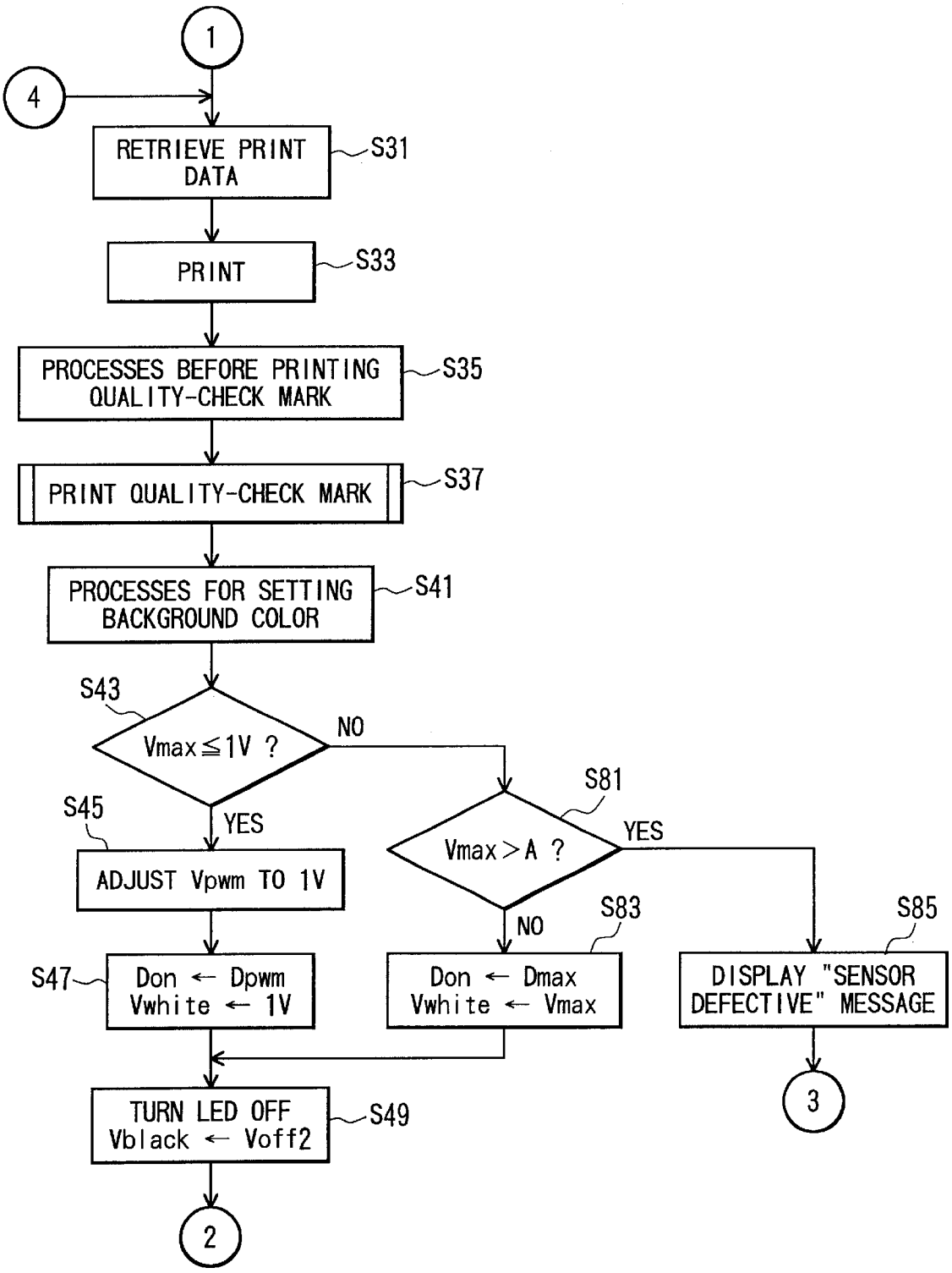
FIG. 8 is a flowchart showing another part of the facsimile reception printing operation executed by the multifunction device.

When sheet feed operations are properly performed with no paper jam (No in S23), then the program proceeds to S31 of FIG. 8. In S31, print data (reception data) is retrieved from the reception memory 64. Then in S33, images are printed by driving, according to the print data, the sheet supply motor 62, the carriage motor 63, and the ink jet head ID. The images are printed in black only through driving only the black ink ejection nozzles on the print head ID. Thus, one page's worth of printing is performed onto the printing region 72 in the printing sheet as shown in FIG. 11.

When one page's worth of printing has been completed, the program proceeds to S35, where preparatory processes are performed for printing a quality-check mark 71 on the printed sheet. During the quality-check mark printing preparatory processes, the sheet supply motor 62 is driven to rotate a predetermined amount required to transport the quality-check mark print position 73 on the sheet, which is located to the rear of the print range 72 as shown in FIG. 11, into alignment with the printing position 48 along the sheet transport direction Y. The predetermined amount is calculated based on the data of the quality-check mark print position 73 which is defined along the direction Y and which is stored in the memory region 114A in the ROM 114.

In S37, the ink jet head ID, the sheet supply motor 62, and the carriage motor 63 are driven to print the quality-check mark 71 as shown in FIGS. 11 and 12. The motors 62, 63 and the ink jet head ID are controlled based on the data A, C, and D stored in the EEPROM 113 and based on the data B stored in the memory region 114A so that the quality-check mark 71 is printed at the position 73 separated from the right side edge of the sheet by the distance A and to have a rectangular shape having the width C and the height D as shown in FIG. 12. The mark 71 is printed in black.

Figure 10:
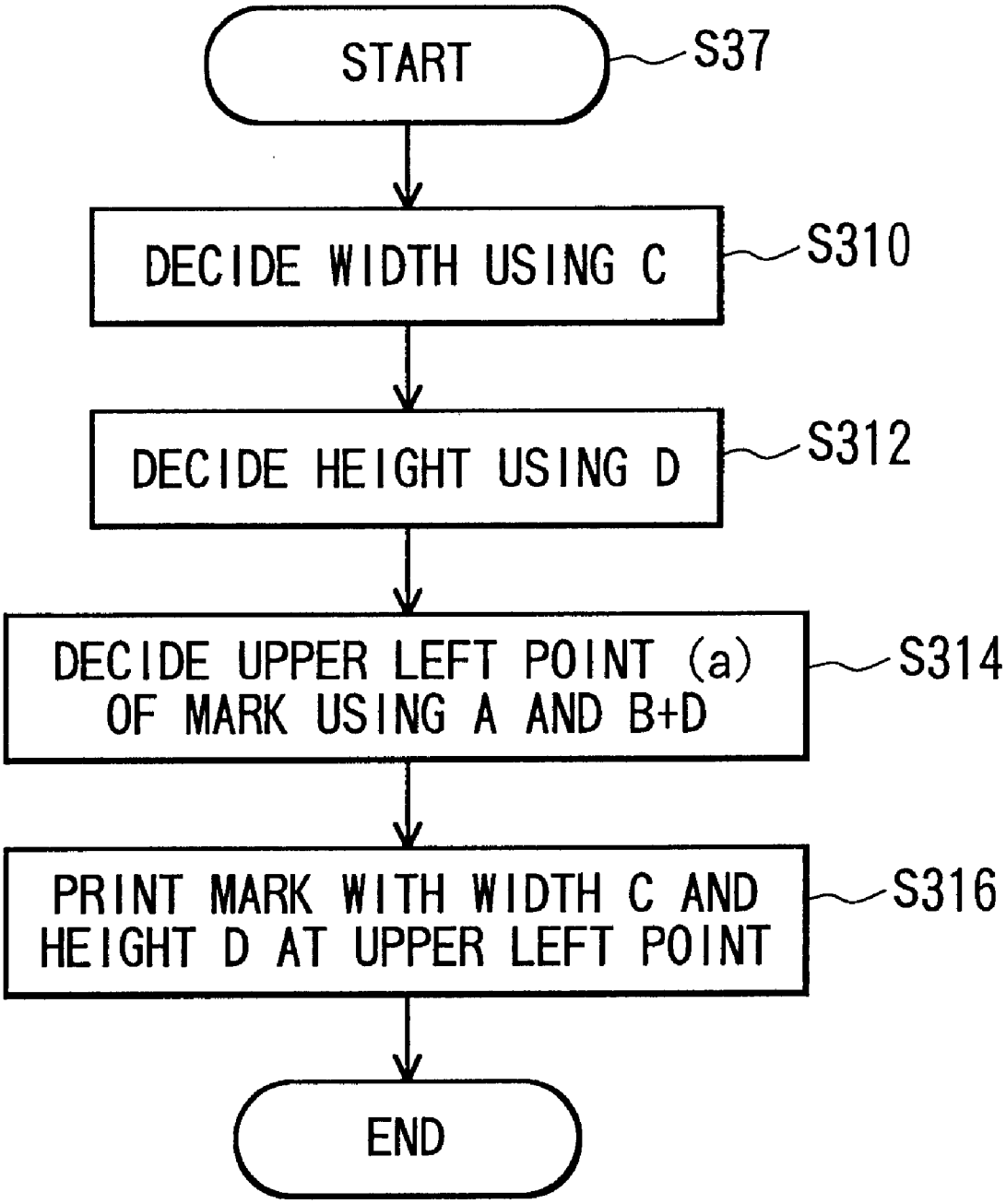
FIG. 10 is a flowchart of a process of S37 for printing a quality-check mark in the process of the facsimile reception printing operation.

The quality-check mark printing operation in S37 is performed as shown in FIG. 10.

First in S310, the width of the quality-check mark 71 is set to width C based on the width data C stored in the EEPROM 113. Then in S312, the height of the quality-check mark 71 is set to height D based on the height data D also stored in the EEPROM 113.

Next in S314, an upper left point "a" of the print-check mark 71 shown in FIG. 12 is set based on distance A and a sum of distance B and height D with using the data A and D stored in the EEPROM 113 and the data B stored in the memory region 114A. Thus, the upper left point "a" is defined as a two-dimensional position (A, B+D) with respect to the trailing right edge point (0, 0) of the printing sheet. The upper left point "a" is therefore distant from the trailing right edge point (0, 0) by the distance of (A) in the main scanning direction X and by the distance of (B+D) in the sheet transport direction Y.

Finally in S316, the quality-check mark 71 is printed with the width C and, the height D from the upper left point "a". More specifically, in S316, the carriage motor 63 is driven to slightly move the ink jet print head ID in the direction X and the sheet supply roller 62 is driven to slightly move the printing sheet along the direction Y so that a leftside end black ink ejection nozzle on the print head ID will accurately confront the upper left point "a" on the sheet. Then, a main scanning operation is performed while controlling all the black ink ejection nozzles in the ink jet head ID to eject black ink. In the main scanning operation, the carriage motor 63 is driven to rotate by an amount corresponding to the width C so that the ink jet head ID is transported in the lateral direction X by the distance C while black ink is being ejected from all the black ink ejection nozzles. The main scanning operation is repeatedly and successively executed while the sheet supply motor 62 is driven to rotate by an amount corresponding to the height D so that the sheet is transported by the distance D in the transport direction Y. Thus, the quality-check mark 71 is printed in a rectangular shape C×D filled in with black ink.

When the ink jet print head ID is in a good printing condition, then the print head ID prints the quality-check mark 71 in the rectangular shape sufficiently filled in with ink. That is, the quality-check mark 71 is printed with a sufficiently high density. The print head ID is in a good printing state when a sufficient amount of black ink remains in the black ink cartridge and all the black ink ejection nozzles are in proper condition with no clogs. On the other hand, if the print head ID is in a defective printing state, the print head ID prints the quality-check mark 71 with its total density being lower than when the print head ID is in the good condition. The print head ID is brought into the defective printing state when the black ink cartridge runs out of black ink or when some black ink ejection nozzles are clogged.

After the quality-check mark 71 is printed in S37, then in S41, the CPU 111 performs processes for determining the background color of the subject printing sheet, on which images and the quality-check mark 71 have been printed. The processes serve to set the background color of the printing sheet to be regarded as white by the sensor 51.

During these processes, the sheet supply motor 62 is rotated by a predetermined amount to position a background color portion 74, shown in FIG. 11, on the printing sheet into confrontation with the detection position 54. As shown in FIG. 11, the sheet background color portion 74 is located between the print range 72 and the quality-check mark printing position 73.

Next, the LED 52 is illuminated at 100% of its duty rate to produce the maximum possible intensity of light. In this condition, the light reception element 53 receives light reflected off the sheet background color portion 74 and outputs a detection voltage Vmax. Then, in S43, the CPU 111 determines whether or not the detection voltage Vmax is one (1) volt or less. If the detection voltage Vmax is equal to or less than 1 volt (Yes in S43), then the program proceeds to S45. In S45, the CPU 111 controls the LED 52 through pulse width modulation (PWM) to adjust its light intensity until the light reception element 53 properly outputs a detection voltage Vpwm of one (1) volt. That is, the CPU 111 controls the duty ratio Dpwm of the LED 52 through pulse width modulation (PWM) to increase or decrease the light intensity until the light reception element 53 properly outputs the detection voltage Vpwm of one (1) volt.

Next in S47, the duty ratio Dpwm, with which the LED 52 is controlled to emit light that results in the light reception element 53 outputting the detection voltage Vpwm of one (1) volt, is set as a control value Don, with which the LED 52 should be controlled. Also, the detection voltage Vpwm of one (1) volt is set as a white level detection voltage Vwhite indicative of the white level. Through these operations, the LED 52 is controlled to emit light with its intensity causing the light reception element 53 to output the white level voltage Vwhite of one (1) volt in response to the background color of the printing sheet presently being used.

Figure 9:
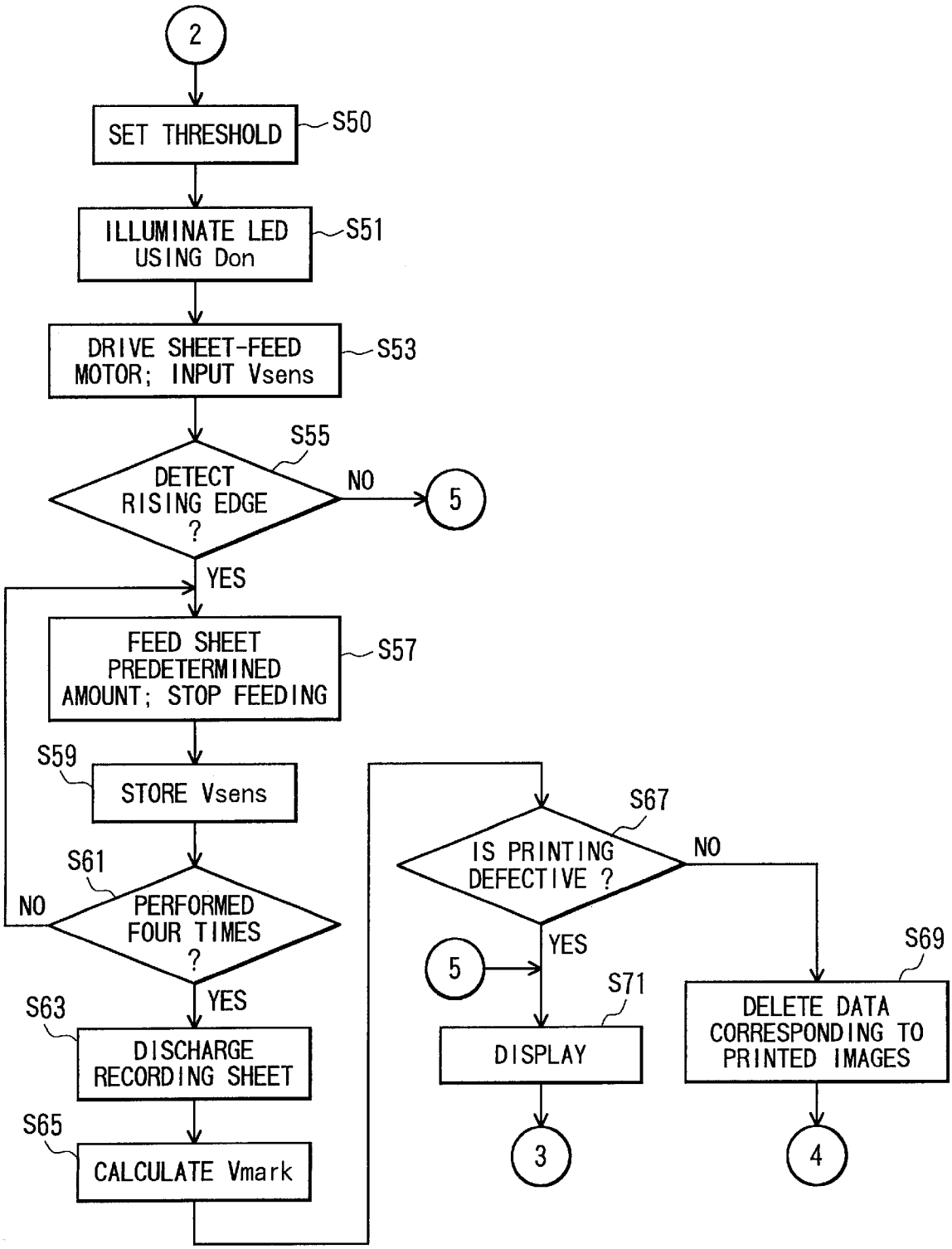
FIG. 9 is a flowchart showing still another part of the facsimile reception printing operation executed by the multifunction device.

Next in S49, the LED 52 is turned off to induce the light reception element 53 to output a detection voltage Voff2. Data of the detection voltage Voff2 is stored as a black level voltage Vblack indicative of the present black level. Next in S50, as shown in FIG. 9, the CPU 111 determines a threshold value to be used during a printing quality judging process of S67 as will be described later. The threshold value is determined using the following formula (1):

$$(\text{Threshold value})=(V\text{black}-V\text{white})\times\text{CNST.}+V\text{white} \quad (1)$$

where CNST. is a constant value less than one (1). For example, CNST. is equal to 0.7.

Thus, the threshold value is determined in correspondence with the actual dynamic range of the reflection sensor 51 under the present condition. The actual dynamic range of the reflection sensor 51 is defined as equal to the value obtained by subtracting the value of the white level detection voltage Vwhite from the black level detection voltage Vblack.

Next, the CPU 111 starts performing a detection process of the quality-check mark 71. First, in S51, the CPU 111 starts controlling the LED 52 with the control duty ratio Don, which has been set in S47 as equal to the duty ratio Dpwm for obtaining the white level detection voltage Vwhite of one (1) volt. Next in S53, the CPU 111 starts driving the sheet supply motor 62 to again transport the printing sheet in the direction Y toward the discharge port 44. While the printing sheet is thus being transported, the light reception element 53 continues outputting a detection voltage Vsens to the CPU 111. When the printing sheet is transported a predetermined amount, the quality-check mark 71 on the sheet reaches the detection position 54. At that time, the detection voltage Vsens will show a rising edge to indicate the presence of the quality-check mark 71 unless the quality-check mark 71 has density of a considerably low amount. If the print head ID is in a considerably bad printing condition, the total density of the quality-check mark 71 is too low to be detected as any rising edges in the detection voltage Vsens. Accordingly, if, despite the sheet being fed the predetermined amount, no rising edge is detected in the detection signal Vsens (No in S55), then the routine Jumps to S71. In S71, a message is displayed on the liquid crystal display 6 for urging the user to execute purging operation on the ink jet print head ID.

On the other hand, if a predetermined rising edge is detected (Yes in S55), then the program proceeds to S57. In S57, the sheet supply motor 62 is further rotated by a predetermined small amount and then is temporarily stopped. In S59, data of the detection voltage Vsens, produced from the light receiving element 53 at this time, is stored in the RAM 112. The sheet feeding process of S57 and the storage process of S59 are repeated (No in S61) four times. When the processes of S57 and S59 are repeated four times (Yes in S61), then the program proceeds to S63. In S63, the sheet supply motor 62 is further driven to discharge the recording sheet onto the recorded sheet stacker 18. Then, the program proceeds to S65, where the CPU 111 calculates an average value Vmark of the four detection voltages Vsens which have been stored during the repeatedly-executed process of S59. The average value Vmark serves as a detection voltage for the quality-check mark 71. Afterward in S67, the CPU 111 determines whether or not defective printing has occurred to the print head ID. The CPU 111 determines that defective printing has occurred when Vmark is lower than the threshold value, which is set in S50. The CPU 111 determines that proper printing has occurred when Vmark is equal to or higher than the threshold value. In other words, the determination in S67 is performed through judging the following formulas (2) and (3):

$$\text{Defective printing: } V\text{mark} < \text{Threshold} \quad (2)$$

$$\text{Proper printing: } V\text{mark} \geqq \text{Threshold} \quad (3)$$

Thus, the CPU 111 can determine occurrence of the defective printing regardless of whether the print head ID has run out of ink or the print head nozzles are clogged.

When it is determined in S67 that defective printing has occurred (Yes in S67), then the program proceeds to S71. In S71, the liquid crystal display 6 is controlled to show a message urging the user to execute purging operations on the ink jet head ID. Then, the program returns to S7 in FIG. 7. When the user pushes the start switch (Yes in S7), the reception data is compulsorily printed in S11. All the reception data, including those reception data for the page presently being printed, presently stored in the reception memory 64 is maintained in the reception memory 64 without being erased. The reception data will be erased from the reception memory 64 in S13 only when the predetermined reset command is inputted in S11.

On the other hand, when it is determined that defective printing has not occurred (No in S67), then the program proceeds to S69. In S69, the CPU 111 erases, from the memory 64, the reception data for the page presently being printed. Next, the routine returns to S31 in FIG. 8 so that data for the next page of document is printed.

On the other hand, when the detection voltage Vmax is greater than one (1) volt (No in S43), then the program proceeds to S81. In S81, the CPU 111 determines whether or not the detection voltage Vmax is greater than the predetermined sensor threshold "A" which is greater than one (1) volt. The sensor threshold "A" is used for determining whether or not the white level voltage, which should be one (1) volt during normal situations, has approached too near the black level voltage. The sensor threshold A is a preset value, and is prestored in the memory region 114A in the ROM 114. For example, the threshold value A is equal to a fixed value of 2.5 volts or a value of 0.7×Vblack wherein Vblack is either a default value of five (5) volts or the value Vblack set in the process of S49 which has been already executed.

When the detection voltage Vmax is equal to or less than the sensor threshold value A (No in S81), then the program proceeds to S83. In S83, the duty ratio Dmax (=100%), which has caused the LED 52 to emit the maximum intensity, is set for the control duty ratio Don, with which the LED 52 should be controlled. The detection voltage Vmax, which the light reception element 53 has produced when the LED 52 has been controlled by the duty ratio Dmax, is set for the voltage Vwhite to be used for calculating the threshold value in S50. Afterward, the routine proceeds to S49.

On the other hand, when the detection voltage Vmax is greater than the sensor threshold value A (Yes in S81), this means that the detection voltage Vmax, which the light reception element 53 produces when the LED 52 produces light with its maximum intensity, approaches too near the black level. Accordingly, the CPU 111 determines that the reception type sensor 51 has a dynamic range too small to properly perform the decisions of S55 and S67. This type of problem can be caused by ink or other foreign matter covering the light receiving surface of the light reception element 53. Accordingly, the program proceeds to S85, wherein the liquid crystal display 6 is controlled to show a message saying "SENSOR DEFECTIVE". Afterward, the routine returns to S7 of FIG. 7. As a result, printing of subsequent pages is stopped unless the user inputs his/her desire to print the subsequent pages through manipulating the start switch (Yes in S7).

As described above, according to the present embodiment, after images have been printed in S33 on the recording sheet based on facsimile data, then in S35 the printing sheet is fed the predetermined distance so that the ink jet print head ID moves relative to the printing sheet from its printing range 72 to its quality-check mark printing position 73. Then, the ink jet head ID is operated in S37 to eject ink from all the black ink ejection nozzles to print the quality-check mark 71. The quality-check mark 71 is a rectangular shape printed solid when the print head ID is under normal conditions. Then, in S67, it is determined whether or not printing is defective based on the intensity of light reflected from the quality-check mark 71. Defective printing can be detected regardless of whether the defective printing is caused by a lack of ink or by clogged nozzles, which is a particular problem with ink jet heads. For example, if ink is lacking, then the color of the quality-check mark overall will become slightly lighter than under optimum conditions. In this case, defective printing is determined according to the above-described formula (2). Thus, defective printing caused by ink running out can be reliably detected. When nozzles are clogged even while ink is in plentiful supply, then the quality-check mark 71 will not be partly printed at positions corresponding to the clogged nozzles. As a result, total intensity of light reflected from the quality-check mark 71 overall will become weak. Also in this case, defective printing is determined according to the formula (2). Therefore, again defective printing can be reliably detected.

According to the present embodiment, the mark size/position setting processes of FIGS. 14–16 are executed in order to print, during the printing processes of FIGS. 7–10, the quality-check mark 71 in an optimum size (width C and height D) and at an optimum position (distance A) with respect to the rightside edge of the sheet. Data of the optimum size and position are set and then stored in the EEPROM 113. During the above-described printing processes of FIGS. 7–10, the quality-check mark 71 is printed in S37 with the optimum size and at the optimum position based on the data stored in the EEPROM 113. Accordingly, in S57–S61, the reflection type sensor 51 can properly detect the quality-check mark 71 to output accurate detection voltages Vsens. The reflection type sensor 51 will output as close as possible to the ideal black level signal of five (5) volts when the quality-check mark 71 has been properly printed by the print head ID. The reflection type sensor 51 will suffer from no influences from the differences between the respective multifunction devices 1 in the position where the sensor 51 is attached and the position where the sheet is transported.

The processes for setting size and position of the quality-check mark 71 will be described below in detail below.

The mark size/position setting processes are performed before the multifunction device 1 is shipped from the factory. The mark size/position setting processes can be performed also by the user of the multifunction device 1. Accordingly, even if the optimum printing conditions of the quality-check mark 71 change with time, the user can reset the printing conditions, i.e., the sizes and positions of the quality-check mark 71.

During the mark size/position setting processes, the size and position of the quality-check mark 71 is set optimum for the subject multifunction device 1. As described above, the position of the quality-check mark 71 is defined by the distance A of the quality-check mark 71 from the rightside edge of a printing sheet. The size of the quality-check mark 71 is defined by both: height D to which the quality-check mark 71 extends in the sheet transport direction Y; and width C to which the quality-check mark 71 extends in the print head scanning direction X. The quality-check mark 71 has a rectangular shape, but may have a square shape according to the set values of the height D and the width C.

Figure 13:
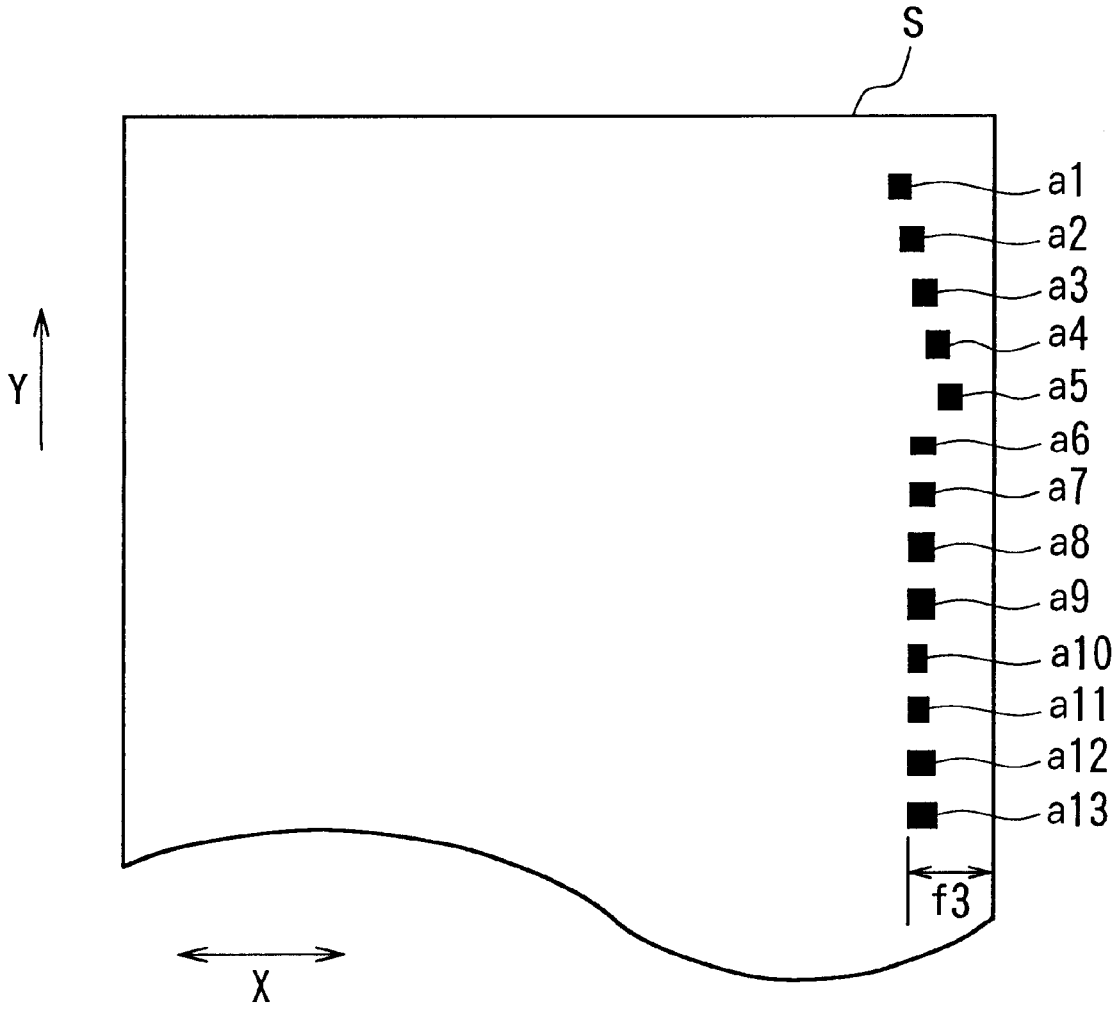
FIG. 13 illustrates how a plurality of position setting marks and a plurality of size setting marks are preprinted on a mark selection sheet S.

During the mark size/position setting processes, a mark selection sheet S shown in FIG. 13 is used. The mark selection sheet S has printed thereon a variety of different solid black setting marks "a1" to "a13". As described later, during the mark size/position setting processes, the mark selection sheet S is mounted on the sheet feed portion 16 of the multifunction device 1. The mark selection sheet S is transported along the sheet pathway 45 in FIG. 3 in the sheet transport direction Y in the same manner as the printing sheet during the above-described printing operations of FIGS. 7–10. The mark selection sheet S is then transported to the detection position 54. Then, intensity of light reflected from each of the setting marks "a1" through "a13" is detected by the light reception element 53. Voltage outputted from the light reception element 53 for each of the marks a1–a13 is referred to to select an optimum position and size for the quality-check mark 71.

The mark selection sheet S will be described below in greater detail.

All the marks a1–a13 are aligned generally following the transport direction Y of the mark selection sheet S, but have varying heights, widths, and distances from the rightside edge of the mark selection sheet S as listed in Table 1 below.

TABLE 1

| | DISTANCE FROM RIGHTSIDE EDGE | HEIGHT | WIDTH |
|---|---|---|---|
| a1 | f1 | H | W( = H) |
| a2 | f2 | H | W |
| a3 | f3 | H | W |
| a4 | f4 | H | W |
| a5 | f5 | H | W |
| a6 | f3 | h1 | W |
| a7 | f3 | h2 | W |
| a8 | f3 | h3 | W |
| a9 | f3 | h4 | W |
| a10 | f3 | H | w1 |
| a11 | f3 | H | w2 |
| a12 | f3 | H | w3 |
| a13 | f3 | H | w4 |

Data of the Table 1 is previously stored in the memory region 114B of the ROM 114.

The marks (position setting marks) a1–a5 are used for determining the appropriate distance A from the right side of the sheet where the quality-check mark 71 should be printed. All the marks a1–a5 are square black marks having the same height H and the same width W, wherein the height H equals the width W. The marks a1–a5 are separated from the right side edge of the mark selection sheet S each by different distance f1–f5, wherein f1>f2>f3>f4>f5.

The above-described mark a3 and the marks a6–a9 (height setting marks) are used for determining the optimum height D of the quality-check mark 71. All the marks a3 and a6–a9 are printed with the same width W, and are separated from the right side edge of the sheet by the same distance f3. The marks a3 and a6–a9 have different heights H and h1–h4, respectively, wherein h1<h2<H<h3<h4. Thus, the mark a3 can be used as a size setting mark, in addition to being used as the position setting mark, because the mark a3 is positioned separated from the right side of the sheet by the same distance f3 as the marks a6–a9 and also has a different height from the marks a6–a9, and so can be used for determining the appropriate height D of the quality-check mark 71.

The above-described mark a3 and other remaining marks a10 to a13 (width setting marks) are for determining the optimum width C of the quality-check mark 71. The marks a3 and a10 to a13 are all positioned separated from the right side of the mark selection sheet S by the same distance f3 and have the same height H. The marks a3 and a10 to a13 are printed with different widths W and w1–w4, respectively, wherein w1<w2<W<w3<w4. Thus, the mark a3 can be used as a size setting mark, in addition to being used as the position setting mark, because the mark a3 is positioned separated from the right side of the sheet by the same distance f3 as the marks a10–a13 and also has a different width from the marks a10–a13, and so can be used for determining the appropriate width C of the quality-check mark 71.

Thus, the above-described height setting marks a3 and a6–9 and the above-described width setting marks a3 and a10–a13 serve as size setting marks for determining the optimum size of the quality-check mark 71.

As shown in FIG. 13, all the above-described marks a1–a13 are separated from one another by a predetermined uniform distance along the sheet transport direction Y.

Data of the above-described widths (w1, w2, W, w3, and w4), heights (h1, h2, H, h3, and h4), and distances f1, f2, f3, f4, and f5 from the right side edge of the mark selection sheet S are stored in the region 114B of the ROM 114. That is, data of the Table 1 is stored in the region 114B. Data of positions, where the marks a1–a13 are printed on the mark selection sheet S in the sheet transport direction Y, is also stored in the region 114B. More specifically, data of a position, where the first mark a1 is printed on the sheet S along the sheet transport direction, is stored in the region 114B. Data of the uniform distance, by which the marks a1–a13 are separated from one another along the sheet transport direction Y, is also stored in the region 114B.

The mark size/position setting processes are executed by the CPU 111 according to routines represented by the flowcharts shown in FIGS. 14 through 16.

The mark size/position setting processes are started when the user sets the mark selection sheet S of FIG. 13 on the sheet feed portion 16 and then performs a predetermined operation to instruct starting of the mark size/position setting processes. For example, the mark size/position setting processes are started when the user sets the mark selection sheet S on the sheet feed portion 16 and presses three times the sharp button 7 on the operation panel 5.

When these starting operations are performed, then in S101, the mark selection sheet S is started being transported in the direction Y toward the recorded sheet stacker 18 along the sheet pathway 45 in the same manner as printing sheets during the above-described normal printing operations of FIGS. 7–10. The sheet supply motor 62 is controlled in S103 to rotate a predetermined amount R1 to transport the mark selection sheet S a predetermined distance L1, to thereby bring the mark a1 on the mark selection sheet S into alignment with the detection position 54 along the sheet transport direction Y.

It is noted that the distance L1 is determined in a manner described below. It is assumed that the sheet supply motor 62 has to be rotated N number of feed steps during the normal printing operation of FIGS. 7–10 in order to bring the quality-check mark printing position 73 into alignment with the detection position 54, and that the mark a1 is printed on the mark selection sheet S at a position n number of feed steps upward from the quality-check mark print position 73. In this case, the predetermined distance L1 is determined in correspondence with the difference between the N number of feed steps and the n number of feed steps, that is, N–n steps where the step numbers N and n are integral numbers.

After the mark selection sheet S is thus started being transported, immediately before the mark a1 reaches the detection position 54, the LED 52 in the reflection type sensor 51 is turned ON. Light irradiated from the LED 52 is reflected off the mark selection sheet S and is received by the light reception element 53. The CPU 111 attempts to read the detection voltage Vsens outputted from the light reception element 53. When the sheet feed motor 62 has been completely rotated by the predetermined amount R1 and therefore the mark a1 has properly reached the detection position 54, the detection voltage Vsens should show a predetermined rising edge. Even when the sheet feed motor 62 has been completely rotated by the predetermined amount R1 and therefore the mark a1 should have reached the detection position 54, if the detection voltage Vsens does not show the predetermined rising edge, this means that a paper jam has occurred to the mark selection sheet S. Accordingly, if the CPU 111 is incapable of detecting the rising edge after the sheet feed motor 62 has rotated the amount RI (No in S105), then the CPU 111 determines that a paper jam has occurred. Accordingly, the program proceeds to S107, where a sheet feed error processes are performed. During the sheet feed error processes of S107, the sheet supply motor 62 is stopped, and the liquid crystal display 6 is controlled to show a message reading "SHEET FEED ERROR".

On the other hand, when the predetermined rising edge is successfully detected on the detection voltage Vsens (Yes in S105), this means that the mark a1 is properly brought into confrontation with the reflection type sensor 51. Accordingly, the program proceeds to S109. In S109, average detection voltage calculation processes are performed. During the average detection voltage calculation processes, the CPU 111 calculates an average detection voltage indicative of an average intensity of light reflected from the mark a1. The CPU 111 stores the calculated average detection value in the RAM 112.

The average detection voltage calculation processes of S109 will be described in greater detail with reference to FIG. 15.

First in S201, the sheet supply motor 62 is further rotated a predetermined slight amount R2 after the rising edge is detected. Then, rotation of the motor 62 is stopped. Then, in S203, the detection voltage Vsens issued from the reflection type sensor 51 is stored in the RAM 112. At this time, light emitted from the LED 52 is reflected from the mark a1, and is received by the reception element 53. The detection voltage Vsens, produced by the reception element 53, is indicative of the intensity of light reflected from the mark a1. If the processes of S201 and S203 have not yet been performed four times (No in S205), then the processes are repeated until they have been performed four times. Once the processes of S201 and S203 have been performed four times (Yes in S205), then the CPU 111 calculates in S207 an average value Vaver for the four detection voltages Vsens detected and stored during the repeatedly-executed processes of S203. Thus, the average detection voltage Vaver is obtained for the presently-detected mark ("a1" in this example). The average detection voltage Vaver is stored in the RAM 112 in correspondence with data of the mark presently being detected ("a1" in this example).

Afterward, the program returns to S111 in the main routine shown in FIG. 14. In S111, the CPU 111 determines whether or not the average detection voltage Vaver has been determined for all the thirteen marks a1–a13 on the mark selection sheet S. If the average detection voltage Vaver has not yet been determined for all the thirteen marks a1–a13 (No in S111), then in S113, the sheet supply motor 62 is rotated by a predetermined amount R3 required to feed the sheet S by a predetermined amount L3. The predetermined amount L3 is a fixed value precalculated based on the distance between each two adjacent marks on the sheet S along the sheet transport direction Y, and is used to feed the sheet S a predetermined distance to bring a next mark into alignment with the detection position 54.

Next, the routine returns to S105 to try determining the average detection voltage Vaver for the next mark. Once these processes have been repeated so that the average detection voltages Vaver have been obtained for all the marks a1–a13 (Yes in S111), then the program proceeds to S115 shown in FIG. 16.

In S115, the CPU 111 selects one of the marks a1–a5 that has produced the greatest detection voltage Vaver. That is, the CPU 111 selects one of the marks a1–a5 that has reflected the smallest amount of light. More specifically, the CPU 111 selects one of the marks a1–a5 that has obtained the detection voltage greatest and therefore nearest to the ideal black level of five (5) volts initially set for the reflection type sensor 51.

Data of the distance (f1, f2, f3, f4, or f5) of the selected mark from the right edge of the mark selection sheet S is retrieved from where it is prestored in the region 114B of the ROM 114. The distance data is stored in the RAM 112 as the optimum distance data A.

Next, in S117, the CPU 111 compares all the average detection voltages Vaver detected for the marks a3 and a6–a9 with a predetermined threshold value s1. It is noted that data of the threshold value s1 is prestored in the region 114B of the ROM 114. The predetermined threshold value s1 is set as fixed near to the black level detection voltage of five (5) volts. For example, the threshold value s1 is equal to four (4) volts. It is noted that the threshold value s1 can be set as convenient from any voltage near the black level of five (5) volts.

Based on the compared results, the CPU 111 selects, from the marks a3 and a6–a9, one or more allowable marks, whose average detection voltages Vaver are greater than the threshold s1 and therefore can be actually regarded as the black level. The CPU 111 selects one of the allowable marks that has the shortest height among the allowable marks. Data of the height (h1, h2, H, h3, or h4) of the selected mark is retrieved from where it is prestored in the region 114B of ROM 114, and then stored in the RAM 112 as the optimum height D.

Next, in S119, the CPU 111 compares all the average detection voltages Vaver detected for the marks a3 and a10–a13 with another predetermined threshold value s2. It is noted that data of the threshold value s2 is prestored in the region 114B of the ROM 114. The predetermined threshold value s2 is set fixed as also near to the black level detection voltage of five (5) volts. For example, the threshold value s2 is equal to the above-described threshold value s1 of four (4) volts. The threshold value s2 can be set as convenient from any voltage near the black level of five (5) volts and can be set different from the threshold value s1.

Based on the compared results, the CPU 111 selects, from the marks a3 and a10–a13, one or more allowable marks, whose average detection voltages Vaver are greater than the threshold s2 and therefore can be actually regarded as the black level. The CPU 111 selects one of the allowable marks that has the thinnest width among the allowable marks. Data of the width (w1, w2, W, w3, or w4) of the selected mark is retrieved from where it is prestored in the region 114B of ROM 114, and then stored in the RAM 112 as the optimum width C.

In the above-described process of S117, the shortest mark is selected from the one or more allowable marks. In the above-described process of S119, the thinnest mark is selected from the one or more allowable marks. Such a selection operation is performed for the reason described below.

The quality-check mark 71 itself is unnecessary except for determining whether or not printing is defective. At times other than when determining whether printing is defective, the quality-check mark 71 is desirably as small as possible so that it stands out as little as possible. On the other hand, the quality-check mark 71 has to be large enough so that it can be used as a proper reference for determining whether or not printing is defective. Accordingly, the size (width and height) of the quality-check mark 71 is selected as the smallest one from one or more allowable sizes that can provide detection voltages capable of being regarded as the black level.

Then, in S121, the optimum values A, D, and C, which have been stored in the RAM 112 during the processes of S115, S117, and S119, are written in the EPROM 113. Next in S123, the mark selection sheet S is transported to and discharged onto the recorded sheet stacker 18. This ends the mark size/position setting processes.

Thus, the optimum distance data A and the optimum size data C and D are set in S121 in the EEPROM 113. As described already, during the normal printing operations of FIGS. 7–10, after performing printing of desired print data, the quality-check mark 71 is printed as shown in FIG. 12 based on the thus set optimum printing conditions A, C, and D and the previously-set fixed amount of distance B. The quality-check mark 71 is printed at the printing position 73 defined by the data A and B as optimum for the subject multifunction device 1. The printing position 73 is defined by the data A in the print head scanning direction X and by the data B in the sheet transport direction Y. The quality-check mark 71 is printed at the size defined by the data C and D as optimum for the subject multifunction device 1. The size of the quality-check mark 71 is defined by the width data C in the print head scanning direction X and by the height data D in the sheet transport direction Y.

As described above, according to the mark size/position setting processes, the mark selection sheet S is prepared. The mark selection sheet S is preprinted with the plurality of setting marks a1–a13. The setting marks a1–a13 are printed at various positions and with various sizes. Intensity of light reflected from each setting mark is detected by the reflection type sensor 51. Based on the detected results, an optimum position, an optimum height, and an optimum width of the quality-check mark 71 is selected in S115–S119, and then stored in the EEPROM 113.

According to the above-described mark size/position setting processes of FIGS. 14 to 16, conditions (position and size) for printing the quality-check mark 71 can be set to the optimum values, out of the predetermined range of the selectable values, while taking into account slight mechanical variations between respective multifunction devices 1. Accordingly, detection of defective printing will become fully accurate during the printing processes of FIGS. 7–10. It is possible to prevent the multifunction device 1 from erroneously performing unreliable detection of defective printing due to the inappropriate size and position of the quality-check mark 71.

The printing condition of the quality-check mark 71 can be selected optimum not only before the device 1 is shipped from the factory but also by the user of the device 1. Accordingly, even if the optimum printing conditions of the quality-check mark 71 change with time, the user can reset the printing conditions.

During the above-described mark size/position setting processes, the position of the quality-check mark 71 in the sheet transport direction Y is preset by the data B and is not changed afterward. However, an optimum value may be selected also for the data B. A process for selecting the optimum value for the data B can be executed after the mark size/position setting processes of FIGS. 14–16. During the processes for selecting data B, a plurality of mark position selection sheets are prepared. In each mark position selection sheet, a setting mark is printed with the optimum size (C and D) and at the optimum distance A from the side of the sheet. The positions, where the setting marks are printed on the respective mark position selection sheets along their sheet transport direction Y, are slightly different from one another. Processes similar to those of FIGS. 14–16 are attained so as to select one position selection sheet that results in the greatest detection voltage Vaver. The distance B, at which the setting mark is separated from the trailing edge of the selected sheet, is set as the optimum value for the distance B.

A second preferred embodiment of the present invention will be described below.

During the mark size/position setting processes of the first embodiment, the mark selection sheet S is prepared as preprinted with the several setting marks. Contrarily, according to the present embodiment, the mark selection sheet S is produced by the subject multifunction device 1 based on data of Table 1 prestored in the ROM 114.

Similarly to the first embodiment, according to the present embodiment, data of the widths (w1, w2, W, w3, and w4), the heights (h1, h2, H, h3, and h4), and the distances f1, f2, f3, f4, and f5 from the right side edge of the mark selection sheet are stored in the region 114B of the ROM 114. That is, data of the Table 1 is stored in the region 114B. Data of positions, where position setting marks, height setting marks, and width setting marks should be printed on the mark selection sheet in the sheet transport direction Y, is also stored in the region 114B. For example, data of a position, where a mark should be printed first in the sheet transport direction Y, is stored in the region 114B. Data of a distance, by which the marks should be separated along the sheet transport direction Y, is also stored in the region 114B.

With this structure, when a sheet desired to be printed with the setting marks a1–a13 is set in the sheet feed position 16, the CPU 111 controls, based on the data stored in the region 114B, the sheet transport motor 62, the carriage motor 63, and the ink jet print head ID to print the marks a1–a13 on the sheet in the same manner as shown in FIG. 13, thereby producing the mark selection sheet S. Then, the mark size/position setting processes are performed in the same manner as in the first embodiment with using the thus printed out mark selection sheet S. According to this embodiment, there is no need to prepare the separate mark selection sheet S.

While the single sheet is thus transported once from the sheet feed position 16 to the recorded sheet stacker 18, the setting marks a1–a13 are printed on the sheet by the print head ID and then the printed setting marks a1–a13 are optically detected to determine the optimum size and position of the quality-check mark 71. This configuration is desirable because the number of times the sheet is transported can be reduced to only one.

However, the sheet may be first transported from the sheet feed position 16 to the recorded sheet stacker 18 so that the setting marks a1–a13 are printed on the sheet by the print head ID. Then, the sheet may be again transported from the sheet feed position 16 to the recorded sheet stacker 18 so that the printed setting marks a1–a13 will be optically detected to determine the optimum size and position of the quality-check mark 71.

Figure 17:
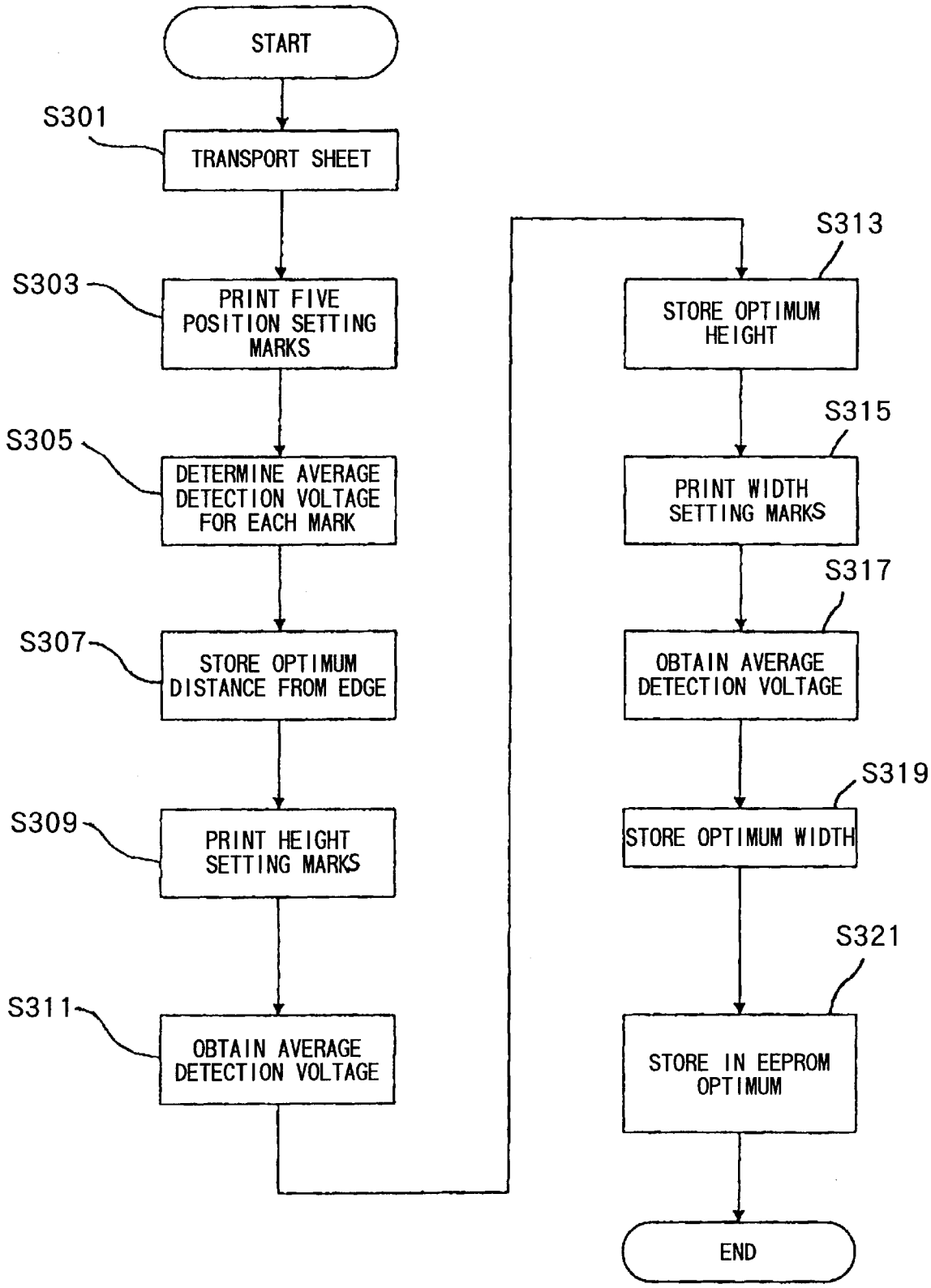
FIG. 17 is a flowchart of the mark size/position setting processes according to a third embodiment.

A third embodiment of the present invention will be described below with reference to FIG. 17.

Also in the present embodiment, the mark selection sheet S is printed by the multifunction device 1.

Similarly to the second embodiment, according to the present embodiment, data of the widths (w1, w2, W, w3, and w4), the heights (h1, h2, H, h3, and h4), and the distances f1, f2, f3, f4, and f5 from the right side edge of a mark selection sheet are stored in the region 114B of the ROM 114. That is, data of the Table 1 is stored in the region 114B. Data of positions, where position setting marks, height setting marks, and width setting marks should be printed on the mark selection sheet along the sheet transport direction Y, is also stored in the region 114B. For example, data of a position, where a mark should be printed first in the sheet transport direction Y, is stored in the region 114B. Data of a distance, by which marks should be separated along the sheet transport direction Y, is also stored in the region 114B.

The mark size/position setting processes of the present embodiment will be described below while referring to FIG. 17.

When the user mounts, on the sheet feed portion 16, a sheet desired to be printed with a plurality of position setting marks and size setting marks, the user operates the predetermined operations on the panel 5 for instructing start of the mark size/position setting processes. For example, the user presses the asterisk button three times. As a result, the processes of FIG. 17 is started, and the sheet is transported in S301.

Then in S303, the CPU 111 controls the ink jet head ID to serially print several (five, in this example) square-shaped position setting marks with sides equaling the height H. The position setting marks are separated from the right side edge of the sheet by different distances f1–f5. The marks are separated from one another by the predetermined distance along the sheet transport direction. Thus, the position setting marks are printed through controlling the ink jet print head ID, the sheet transport motor 62, and the carriage motor 63 based on the data stored in the ROM region 114B.

While each of these printed marks passes by the detection position 54, the reflection type sensor 51 outputs detection signals Vsens according to intensity of light reflected from each printed mark. In S305, therefore, the detection voltage Vsens is serially detected four times at each mark, and an average detection voltage Vaver is calculated for each mark in the same manner as in S109 in the first embodiment. Then, in S307, all the average detection voltages Vaver obtained for all the marks are compared with one another, and the optimum mark with the greatest detection voltage Vaver is selected from the printed marks through the same process as described in S115 in the first embodiment. Data of the distance (f1, f2, f3, f4, or f5) of the selected mark from the right side of the sheet is then stored in the RAM 112 as the optimum distance A.

Next in S309, several (five, in this example) height setting marks, all having the same width W (=H), are printed with different heights h1, h2, H, h3, and h4. All the plurality of marks are printed at positions separated from the right side edge of the sheet by the same optimum distance A which has been determined in S307. These marks are printed serially as separated from one another by the predetermined uniform distance along the sheet transport direction Y. Thus, the height setting marks are printed through controlling the ink jet print head ID, the sheet transport motor 62, and the carriage motor 63 based on the data stored in the RAM 112 and the ROM region 114B.

While each of these printed marks passes by the detection position 54, the reflection type sensor 51 outputs detection signals Vsens according to intensity of light reflected from each printed mark. In S311, therefore, the detection voltage Vsens is serially detected four times at each mark, and an average detection voltage Vaver is calculated for each mark in the same manner as in S109 in the first embodiment. Then, in S313, all the average detection voltages Vaver obtained for all the marks are compared with the threshold s1 and the optimum mark is selected from the printed marks through the same process as described in S117 for the first embodiment. Data of the height (h1, h2, H, h3, or h4) of the selected mark is then stored in the RAM 112 as the optimum height D.

Next in S315, several (five, in this example) width setting marks, having different widths (w1, w2, W, w3, and w4) but having the same optimum height D determined in S313, are serially printed as separated from the right side edge of the sheet by the same optimum distance A determined in S307. The width setting marks are separated from one another by the predetermined uniform distance along the sheet transport direction Y. Thus, the width setting marks are printed through controlling the ink jet print head ID, the sheet transport motor 62, and the carriage motor 63 based on the data stored in the RAM 112 and the ROM region 114B.

While each of these printed marks passes by the detection position 54, the reflection type sensor 51 outputs detection signals Vsens according to intensity of light reflected from each printed mark. In S317, therefore, the detection voltage Vsens is serially detected four times at each mark, and an average detection voltage Vaver is calculated for each mark in the same manner as in S109 in the first embodiment. Then, in S319, all the average detection voltages Vaver obtained for all the printed marks are compared with the threshold s2 and the optimum mark is selected from the printed marks through the same process as described in S119 for the first embodiment. Data of the width (w1, w2, W, w3, or w4) of the selected mark is then stored in the RAM 112 as the optimum width C.

Finally in S321, data of the optimum distance A from the edge of the sheet and the optimum height D and width C of the quality-check mark 71, which are now stored in the RAM 112, are written in the EPROM 113.

According to the above-described mark size/position setting processes of the present embodiment, the optimum distance A from the edge of the sheet, the optimum height D and the optimum width C of the quality-check mark 71 are selected not separately, but are determined in connection with one another. That is, in order to determine the optimum size of the quality-check mark 71, the setting marks are printed at the already-determined optimum distance A from the edge of the sheet. Accordingly, more suitable conditions for printing the quality-check mark 71 can be determined.

In the above-description, after the optimum distance A from the edge of the sheet is determined, the optimum size (C and D) of the quality-check mark 71 is determined based on the already-determined optimum distance A. However, the optimum size (C and D) can be determined before the optimum distance A. That is, after the optimum size (C and D) of the quality-check mark 71 is determined, the optimum distance A may be determined based on the determined optimum size.

As described above in detail, according to the first through third embodiments, the position and size of the quality-check mark are set to match the respective printing devices. Even if slight variation exists in hardware dimensions of the individual printing devices, such as a slight difference in attachment position of the reflection type sensor 51, the quality-check mark can be printed under optimum conditions. Accordingly, the sensor will always be able to appropriately detect density of the quality-check mark because the position or the size of the quality-check mark are appropriately set with respect to the sensor. Also, it is possible to prevent the sensor from detecting defective printing when printing is being properly performed.

Especially, according to the first embodiment, the mark selection sheet is prepared as preprinted with the plurality of position setting marks a1–a5 and the plurality of size setting marks a3 and a6–a13 at positions separated from one another in the sheet transport direction Y. The plurality of position setting marks a1–a5 are printed in the same size and at different print positions from one edge of the sheet. The plurality of size setting marks a3 and a6–a13 are printed in different sizes and at the same print position from the edge of the sheet. The mark selection sheet S is transported in the sheet transport direction Y so that the position setting marks and the size setting marks serially reach the reflection type sensor 51 positioned at the predetermined detection position 54. The reflection type sensor 51 is controlled to serially detect the position setting marks and the size setting marks through irradiating light onto each mark and receiving light reflected therefrom, thereby outputting a detection signal. The EEPROM 113, serving as a rewritable non-volatile memory, is stored with data of a print position (f1, f2, f3, f4, or f5) of one of the plurality of position setting marks a1–a5 that allows the reflection type sensor 51 to output a detection signal nearest to the predetermined black level Vblack. At least one of the plurality of size setting marks, that allows the reflection type sensor 51 to output a detection signal capable of being regarded as the predetermined black level Vblack, is determined. Then, one of the determined at least one size setting mark that has the smallest size is selected. Data of the print size of the selected one size setting mark is stored in the rewritable non-volatile memory (EEPROM) 113. That is, for height, at least one of the plurality of height setting marks a3 and a6–a9 that results in the detection signal higher than the threshold s1 is determined. For width, at least one of the plurality of width setting marks a3 and a10–a13 that results in the detection signal higher than the threshold s2 is determined. Then, for height, one of the determined at least one height setting mark that has the smallest height is selected. For width, one of the determined at least one width setting mark that has the smallest width is selected. Data of the height of the selected one height setting mark and data of the width of the selected one width setting mark is stored in the rewritable non-volatile memory (EEPROM) 113.

After normal printing operation, the printing device ID is controlled to print, on a printing sheet, a quality-check mark in the print size and at the print position stored in the non-volatile memory 113. The reflection type sensor is controlled to irradiate light onto the quality-check mark, to detect light reflected from the quality-check mark, and to output a detection signal. The detection signal is compared with the threshold value. Then, it is determined that the printing device ID performs defective printing when the detection signal is nearer to the white level Vwhite than the threshold value.

With this configuration, the size and the position of the quality-check mark are not predetermined or fixed, but are individually set for each printing device 1. The optimum mark is selected from the plurality of position setting marks and the plurality of size setting marks which are detected under exactly the same conditions under which the reflection type sensor 51 and the sheet transport mechanism function during actual printing processes. Data on the optimum mark is then stored and set in the rewritable nonvolatile memory 113. Accordingly, during actual printing, the reflection type sensor 51 can detect the quality-check mark having optimum conditions, that is, optimum position and size, for the printing device 1.

One optimum mark is selected from the position setting marks in the above-described manner because the position of the position setting mark corresponds to the position of the quality-check mark to be printed during the normal printing operation. Accordingly, it is desirable that the position setting mark detected as having the highest density should be selected.

One optimum mark is selected from the size setting marks in the above-described manner for the reasons described below. Because the size of the size setting mark corresponds to the size of the quality-check mark to be printed during the normal printing operation. Accordingly, it is desirable that the size setting mark detected as having the highest density be selected. However, the quality-check mark, which is printed on the printing sheet printed with desired images and text, is unnecessary except to determine the printing status.

For this reason, it is desirable that the quality-check mark be small and stand out as little as possible. The actually selected size setting mark is desirably one that shows the best balance between these two points.

In the printing device 1 of the above-described embodiments, the sheet transport mechanism (sheet feed motor 62) is provided as capable of transporting a sheet along the predetermined sheet transport path 45 in the direction Y toward the predetermined sheet discharge port 44. The ink jet print head ID is located in the predetermined printing position 48 over the predetermined sheet transport path 45. The ink jet print head ID is formed with a plurality of nozzles. The reflection type sensor 51 is located at the detection position 54 defined between the printing position 48 and the sheet discharge port 44. The reflection type sensor 51 includes the light emitting element 52 for emitting light toward the detection position 54 on the sheet transport path 45 and the light receiving element 53 for receiving light reflected therefrom to output a detection signal indicative of intensity of the reflected light. The rewritable non-volatile memory (EEPROM) 113 is provided as capable of being stored with data of a printing position and a printing size of a quality-check mark to be printed on a printing sheet.

The ROM region 114B is stored with data of the plurality of position setting marks a1–a5 printed on the mark selection sheet S as separated from one another in the sheet transport direction Y. The plurality of position setting marks a1–a5 are printed at the same size, at the corresponding different positions defined along the sheet transport direction Y, and at different print positions from one edge of the mark selection sheet along the direction X. The ROM region 114B is stored with data of the size, the positions along the sheet transport direction, and the positions from the edge of the mark selection sheet.

The ROM region 114B is also stored with data of the plurality of size setting marks a6–a13 printed on the mark selection sheet S as separated from one another in the sheet transport direction Y. The plurality of size setting marks are printed at different sizes, at the corresponding different positions defined along the sheet transport direction Y, and at the same print position from the edge of the mark selection sheet along the direction X. The ROM region 114B is stored with data of the sizes, the positions along the sheet transport direction, and the position from the edge of the mark selection sheet.

During the mark size and position setting processes, the sheet transport mechanism is controlled to transport the mark selection sheet S, while referring to the data stored in the ROM 114B, so that the plurality of position setting marks a1–a5 will serially reach the detection position 54, thereby allowing the reflection type sensor 51 to output detection signals indicative of intensity of light reflected from all the position setting marks. One of the position setting marks a1–a5 that causes the reflection type sensor 51 to output a detection signal nearest to the predetermined black level Vblack is selected. Data of the print position of the selected position setting mark from the edge of the mark selection sheet is set in the rewritable non-volatile memory (EEPROM) 113.

The sheet transport mechanism 62 is further controlled to transport the mark selection sheet S, while referring to the data stored in the ROM 114B, so that the plurality of size setting marks a6–a13 will serially reach the detection position 54, thereby allowing the reflection type sensor 51 to output detection signals indicative of intensity of light reflected from all the size setting marks. At least one of the size setting marks that causes the reflection type sensor 51 to output a detection signal capable of being substantially near to the predetermined black level Vblack, is determined. One of the determined at least one size setting mark that has the smallest size is selected. Then, data of the print size of the selected size setting mark is stored in the rewritable non-volatile memory (EEPROM) 113. More specifically, for height, at least one of the height setting marks a3 and a6–a9, that causes the reflection type sensor 51 to output a detection signal higher than the threshold s1, is determined. One of the determined at least one height setting mark that has the smallest height thereamong is selected. For width, at least one of the width setting marks a3 and a10–a13, that causes the reflection type sensor 51 to output a detection signal higher than the threshold s2, is determined. One of the determined at least one width setting mark that has the smallest width thereamong is selected. Then, data of the height and width of the selected marks is stored in the rewritable non-volatile memory (EEPROM) 113.

During the normal printing operation, based on inputted print data, the ink jet print head ID and the sheet transport mechanism 62 are controlled to perform desired printing on a printing sheet. The sheet transport mechanism is controlled to transport the printing sheet after the printing operation so as to bring the predetermined background portion 73 of the printing sheet into the printing position, and for controlling the ink jet print head ID to eject ink from all the nozzles, thereby printing a quality-check mark 71 at the print size and at the print position from the edge of the printing sheet, data of which is stored in the rewritable non-volatile memory (EEPROM) 113. The sheet transport mechanism 62 is further controlled to transport the printing sheet so that the quality-check mark 71 reaches the detection position 54. The light emitting element 52 of the reflection type sensor 51 is controlled to emit light onto the quality-check mark 71, thereby causing the light receiving element 53 to receive light reflected from the quality-check mark 71 and to output a detection signal. The detection signal is compared with the threshold value. It is determined that the ink jet print head performs defective printing when the detection signal is nearer to the predetermined white level Vwhite than the threshold value.

With this configuration, the optimum position, that is, where the quality-check mark 71 should be printed from the edge of the sheet, is selected based on the position of the selected one of the plurality of position setting marks, data of which is originally stored in the ROM region 114B. The selected optimum position data is then stored in the non-volatile memory (EEPROM) 113. Further, the optimum printing check mark size (height and width) is determined based on the height and width of the selected height and width setting marks originally stored in the ROM region 114B. Then, data of the optimum quality-check mark size is stored in the non-volatile memory (EEPROM) 113.

Especially, according to the second and third embodiments, the mark selection sheet S is produced through controlling, based on the data stored in the ROM region 114B, the ink jet print head ID and the sheet transport mechanism 62 to print the plurality of position setting marks and the plurality of size setting marks onto the mark selection sheet S.

With this configuration, the printing device is possible to prepare the mark selection sheet S. The printing device 1 can use the mark selection sheet S to set the optimum size and position for the quality-check mark from the selectable sizes and positions.

Especially, according to the third embodiment, during the mark size and position setting processes, the ink jet print head ID and the sheet transport mechanism 62 are first controlled to print the plurality of position setting marks onto the mark selection sheet based on the data stored in the ROM region 114B. Then, one position setting mark is selected as indicative of the optimum position from the edge of the mark selection sheet, and data of the optimum position is set in the RAM 112. Then, based on that data, the ink jet print head ID and the sheet transport mechanism 62 are controlled to print the plurality of size setting marks onto the mark selection sheet at the determined optimum position from the edge of the sheet.

With this configuration, first, the plurality of position setting marks are printed on the sheet. Then, the optimum print position from the sheet edge is selected based on the plurality of position setting marks and stored in the RAM 112. Next, the plurality of size setting marks are printed at the optimum print position from the edge of the sheet based on the data in the RAM 112. The optimum size is then determined based on the plurality of size setting marks. Thus, the plurality of optimum conditions for the quality-check marks, that is, the optimum position and size for the quality-check mark, can be selected together rather than separately so that better conditions can be set.

While the invention has been described in detail with reference to the specific embodiments thereof, it would be apparent to those skilled in the art that various changes and modifications may be made therein without departing from the spirit of the invention.

For example, the multifunction device 1 of the above-described embodiments is capable of performing a variety of different functions such as the print function, the facsimile transmission/reception function, the image retrieval function, the copy function, the telephone function, and the answering function. However, the multifunction device 1 need not be capable of performing all of these different functions and may also be capable of performing other functions than the ones listed above. Further, the present invention is not limited to use in a multifunction device, but could instead be used in a printing device solely capable of printing images, a facsimile machine solely capable of printing facsimile images, and the like.

In the above-described embodiments, the facsimile printing operation is performed in black only. Accordingly, during the facsimile printing operation, the quality-check mark 71 is printed also in black only to indicate whether the black ink cartridge IC has run out of ink or whether any of the black ink ejection nozzles are clogged. The mark size/position setting processes of FIGS. 14–16 are therefore designed to determine optimum size and position of the quality-check mark 71 to be printed in black. However, the present invention can be applied to full color printing operation. In this case, four quality-check marks may be printed on the printing sheet through driving all the cyan, magenta, yellow, and black ink ejection nozzles, respectively. The optimum size and position of all the four quality-check marks can be determined through the above-described mark size/position setting processes performed onto the single black color. However, the optimum size and position of each of the four quality-check marks can be determined separately through using a plurality of size and position setting marks printed at a corresponding color.

What is claimed is:

1. A method for detecting a printing state of a printing device, the method comprising the steps of:

setting a printing condition for printing a quality-check mark on a printing sheet by using a detection sensor;

controlling a printing device to print a quality-check mark at the set printing condition on a printing sheet;

controlling the detection sensor to detect the quality-check mark; and determining a printing state of the printing device based on the detected result.

2. A method as claimed in claim 1, wherein the mark printing condition setting step includes the steps of:

controlling the detection sensor to detect a plurality of mark candidates, which are printed on a mark selection sheet in a plurality of printing condition candidates;

selecting one of the mark candidates whose printing condition candidate allows the detection sensor to output an optimum detection result; and determining the selected printing condition candidate as the printing condition for printing the quality-check mark.

3. A method as claimed in claim 2, wherein the mark printing condition setting step further includes the step of controlling the printing device to print, on the mark selection sheet, the plurality of mark candidates in the plurality of printing condition candidates, the detection sensor being controlled to detect the thus printed mark candidates.

4. A method as claimed in claim 2, wherein the plurality of mark candidates include several mark candidates printed at several size candidates and at the same printing position.

5. A method as claimed in claim 4, wherein the plurality of mark candidates further include other several marks printed at several position candidates and at the same sizes.

6. A method as claimed in claim 5, wherein the printing device is controlled to print the quality-check mark onto a printing sheet while conveying the printing sheet in a sheet transport direction and while scanning the printing device in a printing device scanning direction substantially orthogonal to the sheet transport direction, the detection sensor being disposed over a sheet transport path, on which the sheet is conveyed along the sheet transport direction, at a position defined along the printing device scanning direction, the printing device printing the quality-check mark at a position defined along the printing device scanning direction.

7. A method as claimed in claim 6, wherein the plurality of mark candidates are arranged along the sheet transport direction, the mark candidate detection step controlling the detection sensor to successively detect the plurality of mark candidates.

8. A method as claimed in claim 7, wherein the plurality of mark candidates are arranged along the sheet transport direction with their position candidates being defined along the printing device scanning direction.

9. A method as claimed in claim 7, wherein the plurality of mark candidates are arranged along the sheet transport direction with their size candidates being defined along both the printing device scanning direction and the sheet transport direction.

10. A method as claimed in claim 1, wherein the mark printing condition setting step sets a size of the quality-check mark.

11. A method as claimed in claim 10, wherein the mark printing condition setting step includes the steps of:

controlling the detection sensor to detect a plurality of mark candidates printed on a mark selection sheet at a plurality of size candidates;

selecting, as at least one permissible mark candidate, at least one mark candidate whose size candidate allows the sensor to output a permissible detection result;

selecting, from the selected at least one permissible mark candidate, one mark candidate that has the smallest size among the at least one permissible mark candidate; and determining the selected size as the printing size for printing the quality-check mark.

12. A method as claimed in claim 1, wherein the mark printing condition setting step sets a printing position of the quality-check mark.

13. A method as claimed in claim 12, wherein the mark printing condition setting step includes the steps of:

controlling the detection sensor to detect a plurality of mark candidates printed on a mark selection sheet at a plurality of position candidates;

selecting one mark candidate whose position candidate allows the sensor to output the most proper detection result; and determining the selected position as the printing position for printing the quality-check mark.

14. A method as claimed in claim 1, wherein the detection sensor is of a reflection type for irradiating the quality-check mark with light, for receiving the light reflected from the quality-check mark, and for producing a detection signal indicative of the received light, and wherein the printing state determination step includes the steps of:

comparing, with a threshold, the detection signal produced by the detection sensor; and judging whether the detection signal is nearer to a predetermined first level than the threshold or is nearer to a predetermined second level than the threshold.

15. A method as claimed in claim 14, wherein the mark printing condition setting step includes the steps of:

controlling the detection sensor to detect a plurality of mark candidates printed at a plurality of position candidates;

selecting one mark candidate whose position candidate allows the sensor to output the most proper detection result; and determining the selected position as the printing position for printing the quality-check mark, and wherein the mark candidate selection step includes the step of selecting one mark candidate whose position candidate causes the detection sensor to output a detection signal nearest to the second level.

16. A method as claimed in claim 14, wherein the mark printing condition setting step includes the steps of:

controlling the detection sensor to detect a plurality of mark candidates printed at a plurality of size candidates;

selecting, as at least one allowable mark candidate, at least one mark candidate whose size candidate allows the sensor to output an allowable detection result;

selecting, from the selected at least one allowable mark candidate, one mark candidate that has the smallest size among the at least one allowable mark candidate; and determining the selected size as the printing size for printing the quality-check mark, and wherein the at least one allowable mark candidate selection step selects at least one allowable mark candidate whose size candidate causes the detection sensor to output a detection signal substantially near to the second level.

17. A method as claimed in claim 16, wherein the at least one mark candidate selection step selects at least one allowable mark candidate whose size candidate causes the detection sensor to output a detection signal which is nearer to the second level than a predetermined allowing threshold.

18. A method as claimed in claim 1, wherein the mark printing condition setting step includes the steps of:

controlling the printing device to print a plurality of mark candidates on a mark selection sheet with a plurality of first printing condition candidates;

controlling the detection sensor to detect the plurality of mark candidates;

selecting one of the mark candidates whose first printing condition candidate allows the detection sensor to output an optimum detection result;

determining the selected first printing condition candidate as a first printing condition for printing the quality-check mark;

controlling the printing device to print a plurality of other mark candidates with the determined first printing condition and with a plurality of second printing condition candidates;

controlling the detection sensor to detect the plurality of other mark candidates;

selecting one of the other mark candidates whose second printing condition candidate allows the sensor to output an optimum detection result; and determining the selected second printing condition candidate as a second printing condition for printing the quality-check mark.

19. A method as claimed in claim 18, wherein the first printing condition is a position.

20. A method as claimed in claim 18, wherein the second printing condition is a size.

21. A method as claimed in claim 1, wherein the mark printing condition includes at least one of a position and a size of the quality-check mark.

22. A method as claimed in claim 21, wherein the printing device is controlled to print the quality-check mark onto a printing sheet while conveying the printing sheet in a sheet transport direction and while scanning the printing device in a printing device scanning direction substantially orthogonal to the sheet transport direction, the detection sensor being disposed over a sheet transport path, on which the sheet is conveyed along the sheet transport direction, at a position defined along the printing device scanning direction, the printing device printing the quality-check mark at a position defined along the printing device scanning direction, the mark printing condition including at least one of a position, defined along the printing device scanning direction, and a size of the quality-check mark.

23. A printing apparatus for printing a desired image on a printing sheet with a printing device while detecting a printing state of the printing device, the apparatus comprising:

a printing device capable of printing a desired image onto a printing sheet;

a detection sensor capable of detecting a state of a mark printed on a sheet;

mark printing condition setting means for setting a printing condition for printing a quality-check mark on a printing sheet by using the detection sensor;

print control means for controlling the printing device to print a desired image on the printing sheet and to print a quality-check mark at the set printing condition on the printing sheet;

detection control means for controlling the detection sensor to detect the quality-check mark; and determination means for determining a printing state of the printing device based on the detected result.

24. A printing apparatus as claimed in claim 23, wherein the mark printing condition setting means includes:

sensor control means for controlling the detection sensor to detect a plurality of mark candidates, which are printed on a mark selection sheet in a plurality of printing condition candidates;

selection means for selecting one of the mark candidates whose printing condition candidate allows the detection sensor to output an optimum detection result; and determining means for determining the selected printing condition candidate as the printing condition for printing the quality-check mark.

25. A printing apparatus as claimed in claim 24, wherein the mark printing condition setting means further includes mark printing means for controlling the printing device to print, on the mark selection sheet, the plurality of mark candidates in the plurality of printing condition candidates, the sensor control means controlling the detection sensor to detect the thus printed mark candidates.

26. A printing apparatus as claimed in claim 23, wherein the mark printing condition setting means includes:

sensor control means for controlling the detection sensor to detect a plurality of mark candidates printed on a mark selection sheet at a plurality of size candidates;

first selection means for selecting, as at least one permissible mark candidate, at least one mark candidate whose size candidate allows the detection sensor to output a permissible detection result;

second selection means for selecting, from the selected at least one permissible mark candidate, one mark candidate that has the smallest size among the at least one permissible mark candidate; and determining means for determining the selected size as the printing size for printing the quality-check mark.

27. A printing device as claimed in claim 23, wherein the mark printing condition setting means includes:

sensor control means for controlling the detection sensor to detect a plurality of mark candidates printed on a mark selection sheet at a plurality of position candidates;

selection means for selecting one mark candidate whose position candidate allows the sensor to output the most proper detection result; and determining means for determining the selected position as the printing position for printing the quality-check mark.

28. A printing apparatus as claimed in claim 23, wherein the mark printing condition setting means includes:

first mark print control means for controlling the printing device to print a plurality of mark candidates on a mark selection sheet with a plurality of first printing condition candidates;

first sensor control means for controlling the detection sensor to detect the plurality of mark candidates;

first selection means for selecting one of the mark candidates whose first printing condition candidate allows the detection sensor to output an optimum detection result;

first determining means for determining the selected first printing condition candidate as a first printing condition for printing the quality-check mark;

second mark print control means for controlling the printing device to print a plurality of other mark candidates with the determined first printing condition and with a plurality of second printing condition candidates;

second sensor control means for controlling the detection sensor to detect the plurality of other mark candidates;

second selection means for selecting one of the other mark candidates whose second printing condition candidate allows the sensor to output an optimum detection result; and second determining means for determining the selected second printing condition candidate as a second printing condition for printing the quality-check mark.

29. A method for determining a printing status of a printing device, the method comprising the steps of:

transporting a mark selection sheet, the mark selection sheet being printed with a plurality of position setting marks and a plurality of size setting marks at positions separated from one another in a sheet transport direction of the mark selection sheet, the plurality of position setting marks being printed in the same size and at different print positions from one edge of the sheet, the plurality of size setting marks being printed in different sizes and at the same print position from the edge of the sheet, the mark selection sheet being transported so that the position setting marks and the size setting marks serially reach a predetermined reflection type sensor positioned at a predetermined detection position;

controlling the reflection type sensor to serially detect the position setting marks and the size setting marks, the reflection type sensor irradiating light onto each position setting mark and each size setting mark and receiving light reflected therefrom, thereby outputting a detection signal;

setting, in a rewritable non-volatile memory, a print position of one of the plurality of position setting marks that allows the reflection type sensor to output a detection signal nearest to a predetermined black level;

determining at least one of the plurality of size setting marks that allows the reflection type sensor to output a detection signal capable of being regarded as the predetermined black level, selecting one of the determined at least one size setting mark that has the smallest size among the at least one size setting mark, and setting the print size of the selected one size setting mark in the rewritable non-volatile memory;

controlling a printing device to print, on a printing sheet, a quality-check mark in the print size stored in the non-volatile memory and at the print position stored in the non-volatile memory;

controlling the reflection type sensor to irradiate light onto the quality-check mark, to detect light reflected from the quality-check mark, and to output a detection signal;

comparing the detection signal with a threshold value; and determining that the printing device performs defective printing when the detection signal is nearer to a predetermined white level than the threshold value.

30. A printing device, comprising:

a sheet transport means capable of transporting a sheet along a predetermined sheet transport path in a direction toward a predetermined sheet discharge port;

an ink jet print head provided in a predetermined printing position over the predetermined sheet transport path, the ink jet print head including a plurality of nozzles;

a reflection type sensor located at a detection position between the printing position and the sheet discharge port, the reflection type sensor including a light emitting element for emitting light toward the detection position on the sheet transport path and a light receiving element for receiving light reflected therefrom to output a detection signal indicative of intensity of the reflected light;

a rewritable non-volatile memory means capable of being stored with data of a printing position and a printing size of a quality-check mark;

position setting mark information memory means for storing data of a plurality of position setting marks printed on a mark selection sheet as separated from one another in the sheet transport direction, the plurality of position setting marks being printed at the same size, at the corresponding different positions defined along the sheet transport direction, and at different print positions from one edge of the mark selection sheet, the data including the size, the positions along the sheet transport direction, and the positions from the edge of the mark selection sheet;

size setting mark information memory means for storing data of a plurality of size setting marks printed on the mark selection sheet as separated from one another in the sheet transport direction, the plurality of size setting marks being printed at different sizes, at the corresponding different positions defined along the sheet transport direction, and at the same print position from the edge of the mark selection sheet, the data including the sizes, the positions along the sheet transport direction, and the position from the edge of the mark selection sheet;

print position setting means for controlling the sheet transport means to transport the mark selection sheet, while referring to the data stored in the position setting mark information memory means, so that the plurality of position setting marks will serially reach the detection position, thereby allowing the reflection type sensor to output detection signals indicative of intensity of light reflected from all the position setting marks, the print position setting means selecting one of the position setting marks that causes the reflection type sensor to output a detection signal nearest to a predetermined black level and setting, in the rewritable non-volatile memory means, data of the print position of the selected position setting mark from the edge of the mark selection sheet;

print size setting means for controlling the sheet transport means to transport the mark selection sheet, while referring to the data stored in the size setting mark information memory means, so that the plurality of size setting marks will serially reach the detection position, thereby allowing the reflection type sensor to output detection signals indicative of intensity of light reflected from all the size setting marks, the print size setting means determining at least one of the size setting marks that causes the reflection type sensor to output a detection signal capable of being substantially near to the predetermined black level, selecting one of the determined at least one size setting mark that has the smallest size among the at least one size setting mark, and setting, in the rewritable non-volatile memory means, data of the print size of the selected size setting mark;

printing execution means for controlling, based on inputted print data, the ink jet print head and the sheet transport means to perform desired printing on a printing sheet;

quality-check mark printing means for further controlling the sheet transport means to transport the printing sheet after the printing operation so as to bring a predetermined background portion of the printing sheet into the printing position, and for controlling the ink jet print head to print a quality-check mark at the print size and at the print position from the edge of the printing sheet, data of which is stored in the rewritable non-volatile memory; and printing status judging means for controlling the sheet transport means to transport the printing sheet so that the quality-check mark reaches the detection position, for controlling the light emitting element of the reflection type sensor to emit light onto the quality-check mark, thereby causing the light receiving element to receive light reflected from the quality-check mark and to output a detection signal, for comparing the detection signal with a threshold value, and for judging that the ink jet print head performs defective printing when the detection signal is nearer to a predetermined white level than the threshold value.

31. A printing device as claimed in claim 30, further comprising mark selection sheet production means for producing the mark selection sheet through controlling, based on the data stored in the position setting mark information memory means and the size setting mark information memory means, the ink jet print head and the sheet transport means to print the plurality of position setting marks and the plurality of size setting marks onto the mark selection sheet.

32. A printing device as claimed in claim 31, wherein the mark selection sheet production means includes:

position setting mark printing means for controlling, based on the data stored in the position setting mark information memory means, the ink jet print head and the sheet transport means to print the plurality of position setting marks onto the mark selection sheet;

position setting control means for controlling the print position setting means to select one position setting mark and to set, in the rewritable non-volatile memory means, data of the print position of the selected position setting mark from the edge of the mark selection sheet;

size setting information control means for controlling the size setting mark information memory means to store data of the print position of the plurality of size setting marks from the edge of the mark selection sheet so that the plurality of size setting marks are to be printed at the same print position, from the edge of the mark selection sheet, set by the position setting control means; and size setting mark printing means for controlling, based on the data stored in the size setting mark information memory means, the ink jet print head and the sheet transport means to print the plurality of size setting marks onto the mark selection sheet at the same position from the edge of the sheet set by the position setting control means.

* * * * *